US008849170B2

(12) United States Patent
Priebe et al.

(10) Patent No.: US 8,849,170 B2
(45) Date of Patent: Sep. 30, 2014

(54) TONER FIXER WITH LIQUID-CARRYING POROUS MATERIAL

(71) Applicants: Alan Richard Priebe, Rochester, NY (US); Donald Saul Rimai, Webster, NY (US); Christopher J. White, Avon, NY (US); Kevin Edward Spaulding, Spencerport, NY (US)

(72) Inventors: Alan Richard Priebe, Rochester, NY (US); Donald Saul Rimai, Webster, NY (US); Christopher J. White, Avon, NY (US); Kevin Edward Spaulding, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 53 days.

(21) Appl. No.: 13/662,847

(22) Filed: Oct. 29, 2012

(65) Prior Publication Data

US 2014/0119797 A1 May 1, 2014

(51) Int. Cl.
*G03G 15/20* (2006.01)

(52) U.S. Cl.
CPC ..... *G03G 15/2053* (2013.01)
USPC ..... 399/335; 399/330

(58) Field of Classification Search
USPC ..... 399/330
See application file for complete search history.

(56) References Cited

U.S. PATENT DOCUMENTS

| | | | | |
|---|---|---|---|---|
| 4,636,808 | A | 1/1987 | Herron | |
| 4,654,980 | A | 4/1987 | Bhat | |
| 4,943,816 | A | 7/1990 | Sporer | |
| 4,994,642 | A | 2/1991 | Matsumoto et al. | |
| 5,025,292 | A | 6/1991 | Steele | |
| 5,045,424 | A | 9/1991 | Rimai et al. | |
| 5,172,709 | A | 12/1992 | Eckhardt et al. | |
| 5,594,540 | A | 1/1997 | Higaya et al. | |
| 6,259,887 | B1 | 7/2001 | Awano | |
| 6,309,463 | B1 | 10/2001 | Hess et al. | |
| 6,429,249 | B1 | 8/2002 | Chen et al. | |
| 6,567,641 | B1 | 5/2003 | Aslam et al. | |
| 6,571,080 | B2 * | 5/2003 | Lee et al. | 399/330 |
| 6,588,888 | B2 | 7/2003 | Jeanmaire et al. | |
| 6,797,348 | B1 | 9/2004 | Chen et al. | |
| 6,851,796 | B2 | 2/2005 | Jeanmaire et al. | |
| 6,915,100 | B2 * | 7/2005 | Tani et al. | 399/329 |
| 7,014,976 | B2 | 3/2006 | Pickering et al. | |
| 7,350,902 | B2 | 4/2008 | Dietl et al. | |
| 7,420,141 | B2 * | 9/2008 | Kitano et al. | 219/469 |
| 7,697,877 | B2 | 4/2010 | Asakura et al. | |
| 8,251,505 | B2 | 8/2012 | Hara | |

FOREIGN PATENT DOCUMENTS

EP 0772100 A2 * 5/1997

* cited by examiner

*Primary Examiner* — Clayton E Laballe
*Assistant Examiner* — Leon W Rhodes, Jr.
(74) *Attorney, Agent, or Firm* — Kevin E. Spaulding

(57) ABSTRACT

A toner fixing system has a heating member rotatable around an axis. The heating member includes a liquid-blocking barrier and a backing layer that define a liquid cavity not including the axis. The liquid cavity contains a heating liquid warmed above a glass transition temperature of the toner. A media-transport system transports the receiver medium along a transport path in which the receiver medium contacts or is entrained around the liquid-blocking barrier. Heat is transferred through the liquid-blocking barrier from the warmed heating liquid to the toner, raising a temperature of the toner to a level above the toner glass transition temperature.

12 Claims, 15 Drawing Sheets

FIG. 11
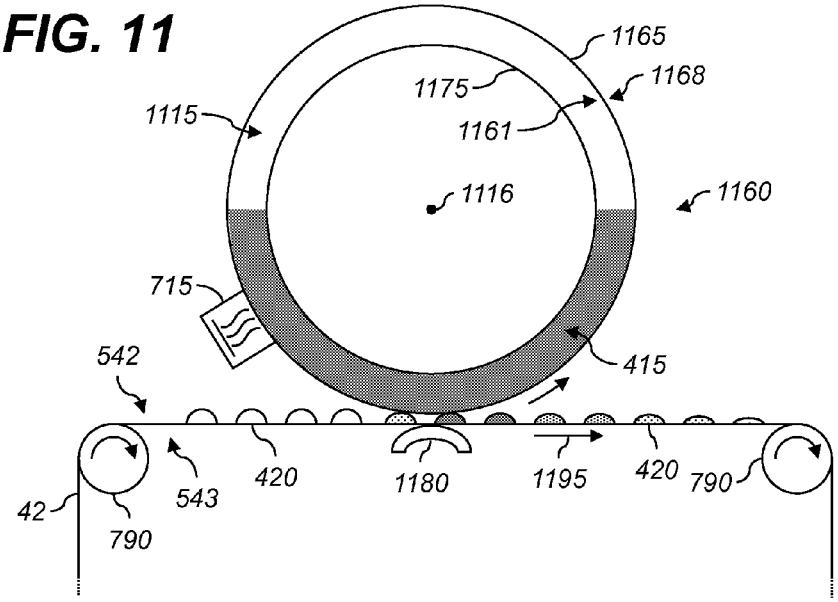
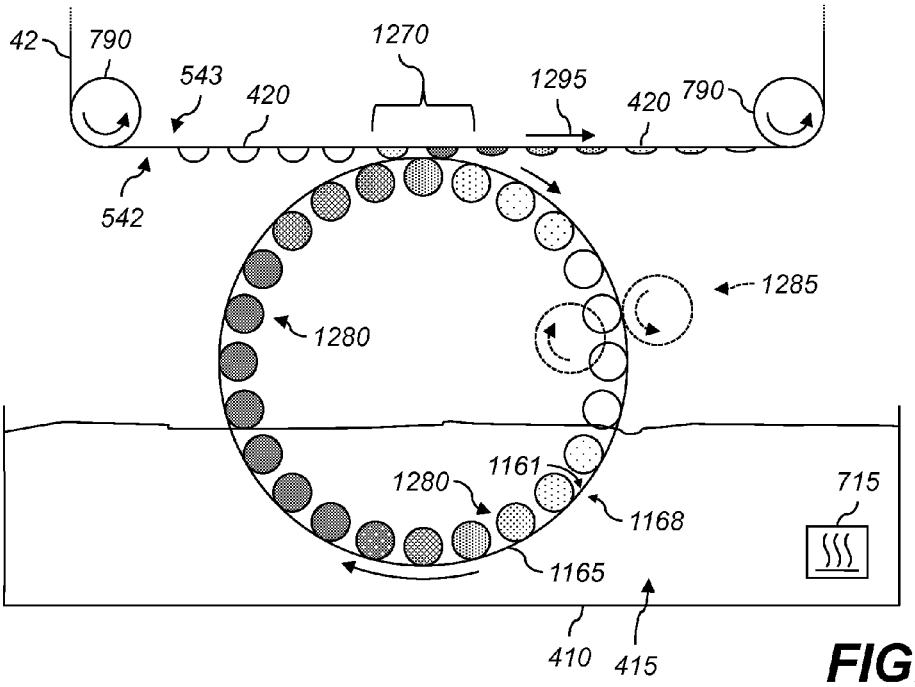
FIG. 12

TONER FIXER WITH LIQUID-CARRYING POROUS MATERIAL

CROSS-REFERENCE TO RELATED APPLICATIONS

Reference is made to commonly assigned, co-pending U.S. patent application Ser. No. 13/649,158, entitled: "Barrier dryer with porous liquid-carrying material", by Priebe et al.; to commonly assigned, co-pending U.S. patent application Ser. No. 13/662,726, entitled "Applying heating liquid to fix toner," by Priebe et al.; to commonly assigned, co-pending U.S. patent application Ser. No. 13/662,752, entitled "Toner fixer transporting medium through heating liquid, by Priebe et al.; to commonly assigned, co-pending U.S. patent application Ser. No. 13/662,771, entitled "Toner fixer impinging heating liquid onto medium, by Priebe et al.; to commonly assigned, co-pending U.S. patent application Ser. No. 13/662.779, entitled "Fixing toner using heating-liquid-blocking bather, by Priebe et al.; to commonly assigned, co-pending U.S. patent application Ser. No. 13/662.798, entitled "Transported medium heating-liquid-barrier toner fixer," by Priebe et al.; to commonly assigned, co-pending U.S. patent application Ser. No. 13/662,811, entitled "Toner-fixing drum containing heating liquid," by Priebe et al.; to commonly assigned, co-pending U.S. patent application Ser. No. 13/662,825, entitled "Toner fixer with heating liquid in cavity," by Priebe et al.; and to commonly assigned, co-pending U.S. patent application Ser. No. 13/662,861, entitled "Toner fixer impinging heating liquid onto barrier," by Priebe et al., each of which is incorporated herein by reference.

FIELD OF THE INVENTION

This invention pertains to the field of toner fixing in printing systems, and more particularly to toner fixing using heat transferred from a heating liquid.

BACKGROUND OF THE INVENTION

Printers generally apply marking substances (e.g., toners) to receivers (e.g., paper). Toners generally include granules of wax or thermoplastic resin. These granules are applied image-wise to a receiver medium, then fixed to form a permanent image. In many printers, fixing is the step that determines the speed at which a printer can operate. It is therefore desirable to fix as quickly as possible to increase printer productivity. Electrophotographic printers are commonly used to form toner images on receiver media.

Various schemes have been described for fixing toners on a marked receiver. Some fixers pass the receiver through an oven. However, air has a low heat capacity, which limits its ability to transfer heat. Moreover, the hot air transfers heat not just to the toner, where the heat is desired, but also to the receiver. This failure to concentrate the applied heat can slow down the fixing process. It is also desirable to keep the temperature of paper receivers low, limiting the thermal power that can be applied.

Other schemes include irradiating the marked receiver (e.g., with infrared or microwave radiation). However, in order to avoid excessive heat absorption in the receiver, the frequency must be carefully chosen. Moreover, many receivers contain some water under normal conditions, as atmospheric moisture falls down its concentration gradient into dry porous or semi-porous sheets. Accordingly, it may not be possible to fix the toner without also heating the receiver.

Conventional fixing devices (sometimes called fusers or tackers) heat applied toner or press applied toner into the receiver. Some fixing devices heat indirectly, e.g., by irradiating the applied toner with infrared radiation. However, these devices can be slow. Moreover, contact fixers, e.g., those that pass marked receivers through a fixing nip with a heated roller, can boil or otherwise vaporize moisture in the receiver during fixing. These fixers generally use metal or polymer nip-forming rollers that substantially inhibit the resulting vapor from exiting the fixing area. This can result in blister formation in the receiver and other image defects. Furthermore, the heated roller on some fixers has a high thermal mass, making it more difficult to change the roller temperature to adjust for variations in fixing characteristics between pages.

U.S. Pat. No. 4,943,816 to Sporer, entitled "High quality thermal jet printer configuration suitable for producing color images," discloses the use of a marking fluid containing no dye so that a latent image in the form of fluid drops is formed on a piece of paper. The marking fluid is relatively non-wetting to the paper. Sporer teaches the use of a 300 dpi thermal inkjet printer to produce the latent image. Surface tension then causes colored powder to adhere to the fluid drops. Sporer teaches that only that portion of the droplet that has not penetrated or feathered into the paper is available for attracting dry ink, so this process is unsuitable for highly-absorbent papers such as newsprint. It is desirable to be able to tone and fix on a wide range of receiver types. Moreover, Sporer's process does not remove moisture from the receiver, so blistering can still result. Also, this process is a hybrid of inkjet and powder printing, so is not suitable for use in conventional electrophotographic printers.

There is, therefore, a continuing need for ways of fixing toner on receivers, e.g., to permit producing high-quality images at high speed using electrophotographic printers.

SUMMARY OF THE INVENTION

According to the present invention, there is provided a toner fixing system for fixing toner onto a receiver medium, the toner having a toner glass transition temperature, comprising:

a rotatable heating member arranged to rotate around an axis, the rotatable heating member having:

- a liquid-blocking barrier with an inner surface and an outer surface; and
- a backing layer affixed to the liquid-blocking barrier to define a liquid cavity, wherein the liquid cavity does not include the axis. the liquid cavity containing a heating liquid sealed between the liquid-blocking barrier and the backing layer such that the heating liquid is in contact with the inner surface of the liquid-blocking barrier;

a liquid-heating system for warming the heating liquid in the liquid cavity to a temperature greater than the toner glass transition temperature; and a media-transport system for transporting the receiver medium along a transport path in which the receiver medium contacts or is entrained around the liquid-blocking barrier so that the receiver medium is brought into contact with the outer surface, such that heat is transferred through the liquid-blocking barrier from the warmed heating liquid to the toner, thereby raising a temperature of the toner to a level above the toner glass transition temperature.

An advantage of the present invention is that it effectively fixes toner on a receiver medium. Using a heating liquid provides an effective rate of heat transfer to the toner, and reduces the probability of blistering, deformation, and other faults that can occur while fixing toner on a receiver constrained in its motion (e.g., in a nip). Various aspects are useful for conventional electrophotographic printing. Various aspects provide reduced probability of image damage during fixing. Various aspects use reduced quantities of heating liquid, permitting energy savings. Various aspects heat the opposite side of the receiver medium from a printed image, reducing the probability of image degradation.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein:

FIGS. 11-17 are elevational cross-sections of toner fixing systems for fixing toner onto a receiver medium according to various aspects;

Figure 1:
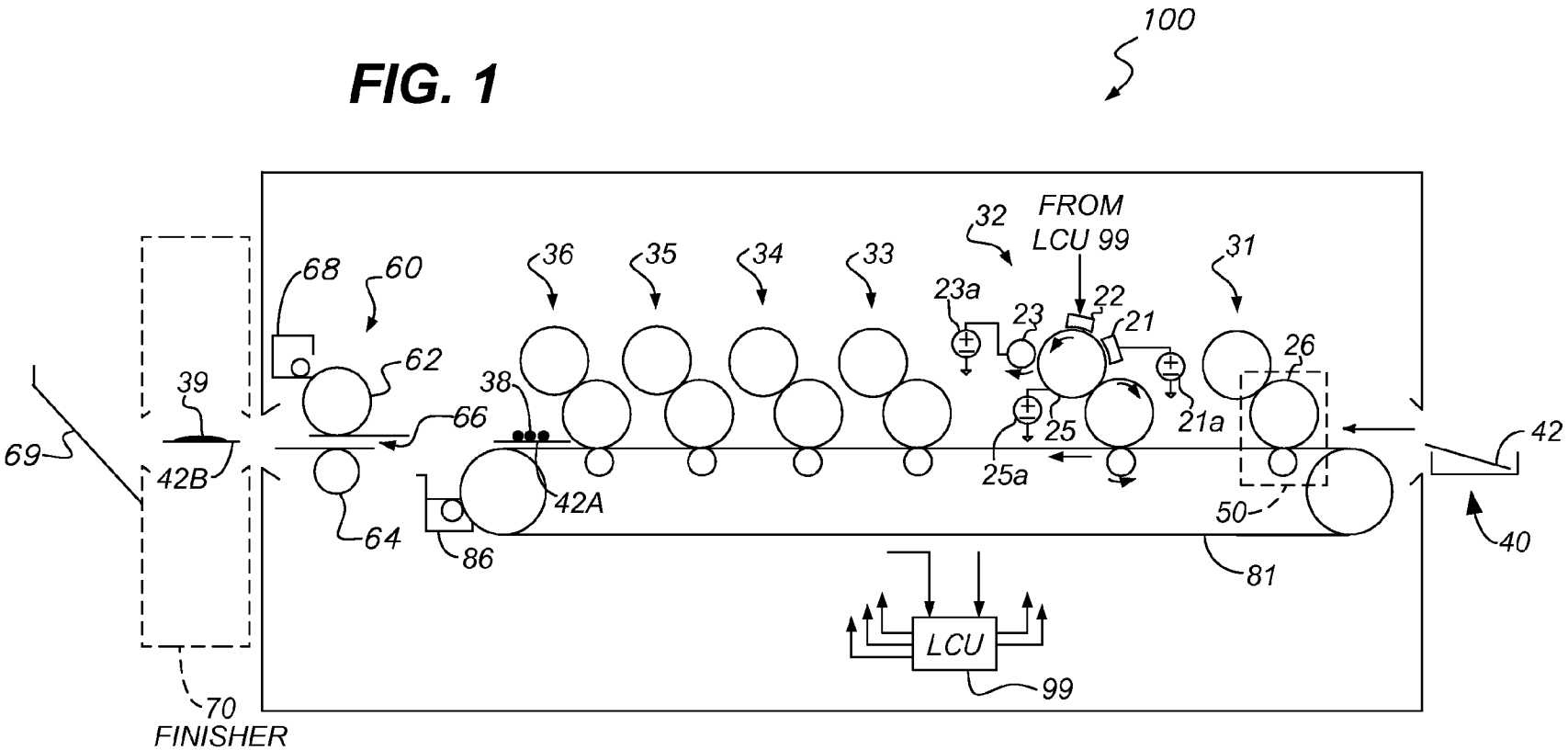
FIG. 1 is an elevational cross-section of an electrophotographic reproduction apparatus.

The attached drawings are for purposes of illustration and are not necessarily to scale.

DETAILED DESCRIPTION OF THE INVENTION

Electrophotographic (EP) and other toner printing processes can be embodied in devices including printers, copiers, scanners, and facsimiles, and analog or digital devices, all of which are referred to herein as "printers." A digital reproduction printing system ("printer") typically includes a digital front-end processor (DFE), a print engine (also referred to in the art as a "marking engine") for applying toner to the recording medium, and one or more post-printing finishing system(s) (e.g., a UV coating system, a glosser system, or a laminator system). A printer can reproduce pleasing black-and-white or color visible images onto a recording medium. A printer can also produce selected patterns of toner on a recording medium, which patterns (e.g., surface textures) do not correspond directly to a visible image. The DFE receives input electronic files (such as Postscript command files) composed of images from other input devices (e.g., a scanner, or a digital camera). The DFE can include various function processors, such as a raster image processor (RIP), an image positioning processor, an image manipulation processor, a color processor, or an image storage processor. The DFE rasterizes input electronic files into image bitmaps for the print engine to print. In some aspects, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the recording medium. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g., digital camera images or film images).

As used herein, the term "paper" refers to a material that is generally made by pressing together moist fibers or weaving fibers. Papers include fibers derived from cellulose pulp derived from wood, rags, or grasses and drying them into flexible sheets or rolls. Paper generally contains moisture which remains after drying or is absorbed from exposure to air. Therefore, the term "paper" used herein includes conventional materials sold as paper and other materials, such as canvas, that possess corresponding characteristics.

As used herein, oliophilic and hydrophobic liquids are defined as organic liquids that are either immiscible, or only slightly miscible, with water. These include aliphatic and aromatic hydrocarbons. Hydrophilic and oliophobic liquids are defined as liquids that are wholly or substantially miscible with water. These include water-based solutions and suspensions such as inkjet inks containing pigments or dyes, water-based solutions, and low carbon alcohols (i.e., alcohols containing four or fewer carbons). Examples include alcohols such as methanol, ethanol, propanol, butanol, isopropanol, isobutanol; glycols such as ethylene glycol, propylene glycol, and butylene glycol; and glycol ethers. Not all components of a hydrophilic liquid are necessarily soluble in water; for example, water-insoluble particles can be suspended in a hydrophilic liquid (e.g., in milk).

As used herein, "toner particles" are particles of one or more material(s) that are transferred by an EP printer to a receiver to produce a desired effect or structure (e.g., a print image, texture, pattern, or coating) on the receiver.

Toner particles can be ground from larger solids, or chemically prepared (e.g., precipitated from a solution of a pigment and a dispersant using an organic solvent), as is known in the art. Toner particles can have a range of diameters, e.g., less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles, and that can form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base. An example of a liquid toner is sub-micron-diameter toner particles suspended in a hydrophobic liquid such as ISOPAR (e.g., ISOPAR-L or ISOPAR-M) or a silicone oil.

Toner includes toner particles and can include other particles. Any of the particles in toner can be of various types and have various properties. Such properties can include absorption of incident electromagnetic radiation (e.g., particles containing colorants such as dyes or pigments), absorption of moisture or gasses (e.g., desiccants or getters), suppression of bacterial growth (e.g., biocides, particularly useful in liquid-toner systems), adhesion to the receiver (e.g., binders), electrical conductivity or low magnetic reluctance (e.g., metal particles), electrical resistivity, texture, gloss, magnetic remanence, fluorescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles (e.g., 15-20 μm or 20-300 μm in diameter). A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

In the following description, some aspects of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, methods described herein. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of aspects herein is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice methods described herein.

FIG. 1 is an elevational cross-section showing portions of a typical electrophotographic printer 100. Printer 100 is adapted to produce print images, such as single-color (monochrome), CMYK, or hexachrome (six-color) images, on a receiver (multicolor images are also known as "multi-component" images). Images can include text, graphics, photos, and other types of visual content. An embodiment involves printing using an electrophotographic print engine having six sets of single-color image-producing or -printing stations or modules arranged in tandem, but more or fewer than six colors can be combined to form a print image on a given receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, 36, also known as electrophotographic imaging subsystems. Each printing module 31, 32, 33, 34, 35, 36 produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver 42, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each printing module 31, 32, 33, 34, 35, 36 includes various components. For clarity, these are only shown in printing module 32. Around photoreceptor 25 are arranged, ordered by the direction of rotation of photoreceptor 25, charger 21, exposure subsystem 22, and toning station 23.

In the EP process, an electrostatic latent image is formed on the photoreceptor 25 by uniformly charging the photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by toning station 23 and are attracted to the latent image to develop the latent image into a visible image. Note that the visible image may not be visible to the naked eye depending on the composition of the toner particles (e.g., clear toner). Toning station 23 can also be referred to as a development station. Toner can be applied to either the charged or discharged parts of the latent image.

After the latent image is developed into a visible image on photoreceptor 25, a suitable receiver 42 is brought into juxtaposition with the visible image. In some arrangements, receiver 42 can be juxtaposed with the photoreceptor 25 to directly transfer the visible image. In other arrangements, the visible image is transferred to intermediate member 26 (e.g., using electrostatic and contact forces) and thence to receiver 42. Intermediate member 26 can be a rotatable member (e.g., a drum or belt). In transfer subsystem 50, a suitable electric field is applied to transfer the toner particles of the visible image from intermediate member 26 to receiver 42 to form the desired print image 38 on the receiver, as shown on receiver 42A. The imaging process is typically repeated many times with reusable photoreceptors 25.

Receiver 42A is then removed from its operative association with photoreceptor 25 and subjected to heat or pressure to permanently fix ("fuse") print image 38 to receiver 42A. In some configurations, plural print images (e.g., of separations of different colors) are overlaid on one receiver 42A before fusing to form a multi-color print image 38 on receiver 42A.

Each receiver 42, during a single pass through the six printing modules 31, 32, 33, 34, 35, 36, can have transferred in registration thereto up to six single-color toner images to form a hexachrome image. As used herein, the term "hexachrome" implies that in a print image, combinations of various of the six colors are combined to form other colors on receiver 42 at various locations on receiver 42. That is, each of the six colors of toner can be combined with toner of one or more of the other colors at a particular location on receiver 42 to form a color different than the colors of the toners combined at that location. In an embodiment, printing module 31 forms black (K) print images, 32 forms yellow (Y) print images, 33 forms magenta (M) print images, 34 forms cyan (C) print images, 35 forms light-black (Lk) images, and 36 forms clear images.

In various embodiments, printing module 36 forms print image 38 using a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 36. Print image 38 on receiver 42A includes unfused toner particles.

Subsequent to transfer of the respective print images 38, overlaid in registration, one from each of the respective printing modules 31, 32, 33, 34, 35, 36, receiver 42A is advanced to a fuser 60 (i.e., a fusing or fixing assembly) to fuse print image 38 to receiver 42A. Transport web 81 transports the print-image-carrying receivers (e.g., 42A) to fuser 60, which fixes the toner particles to the respective receivers 42A by the application of heat and optionally pressure. The receivers 42A are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

In the illustrated configuration, fuser 60 includes a heated fusing roller 62 and an opposing pressure roller 64 that form a fusing nip 66 therebetween. In the illustrated embodiment, fuser 60 also includes a release fluid application substation 68 that applies release fluid (e.g., silicone oil) to fusing roller 62. Alternatively, wax-containing toner can be used without applying release fluid to fusing roller 62. Other embodiments of fusers, both contact and non-contact, can be employed. For example, solvent fixing uses solvents to soften the toner particles so they bond with the receiver 42. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver 42. In various embodiments, fusing is provided by transferring heat from a heating liquid to the toner particles.

The receivers (e.g., receiver 42B) carrying the fused image (e.g., fused image 39) are transported in a series from the fuser 60 along a path either to a remote output tray 69, or back to printing modules 31, 32, 33, 34, 35, 36 to create an image on the backside of the receiver (e.g., receiver 42B), thereby forming a duplex print. Receivers 42 (e.g., receiver 42B) can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes (e.g. color correction) in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Various parameters of the components of a printing module (e.g., printing module 31) can be selected to control the operation of printer 100. In an embodiment, charger 21 is a corona charger including a grid between the corona wires (not shown) and photoreceptor 25. Voltage source 21*a* applies a voltage to the grid to control charging of photoreceptor 25. In an embodiment, a voltage bias is applied to toning station 23 by voltage source 23*a* to control the electric field, and thus the rate of toner transfer, from toning station 23 to photoreceptor 25. In an embodiment, a voltage is applied to a conductive base layer of photoreceptor 25 by voltage source 25*a* before development, that is, before toner is applied to photoreceptor 25 by toning station 23. The applied voltage can be zero; the base layer can be grounded. This also provides control over the rate of toner deposition during development. In an embodiment, the exposure applied by exposure subsystem 22 to photoreceptor 25 is controlled by LCU 99 to produce a latent image corresponding to the desired print image. All of these parameters can be changed, as described below.

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference. Other configurations of printer 100 can be used, e.g., configurations in which more than one toning station 23 is arranged adjacent to photoreceptor 25, and the print image is produced by depositing multiple visible images in register on the photoreceptor and then transferring them together (e.g., via intermediate member 26) to receiver 32, or by moving receiver 42 past photoreceptor 25 or intermediate member 26 multiple times, one for each color separation.

Figure 2:
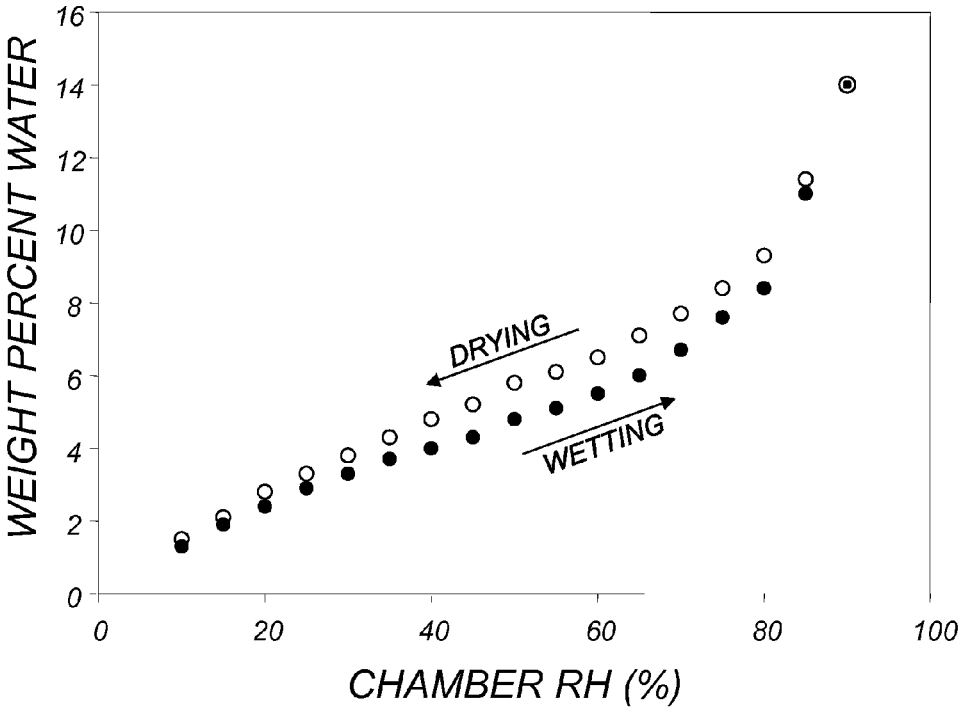
FIG. 2 shows the moisture content of a representative paper equilibrated to the relative humidity.

FIG. 2 shows the moisture content of a selected representative paper (measured in weight percent of water) as a function of atmospheric relative humidity (RH) (measured in percent). To take these measurements, the paper was placed in a chamber containing air at low RH. The moisture content of the chamber was increased in a series of steps. At each step, the paper was left in the chamber for enough time to permit it to equilibrate with the atmosphere in the chamber. The moisture content of the paper was then measured. The resulting data are shown in the solid circles (labeled as "wetting"). After reaching a high RH, the chamber RH was reduced stepwise. As before, at each step the paper was permitted to equilibrate, then was measured. The resulting data are shown in the open circles (labeled as "drying"). As shown, there is some hysteresis in the moisture content.

Figure 3:
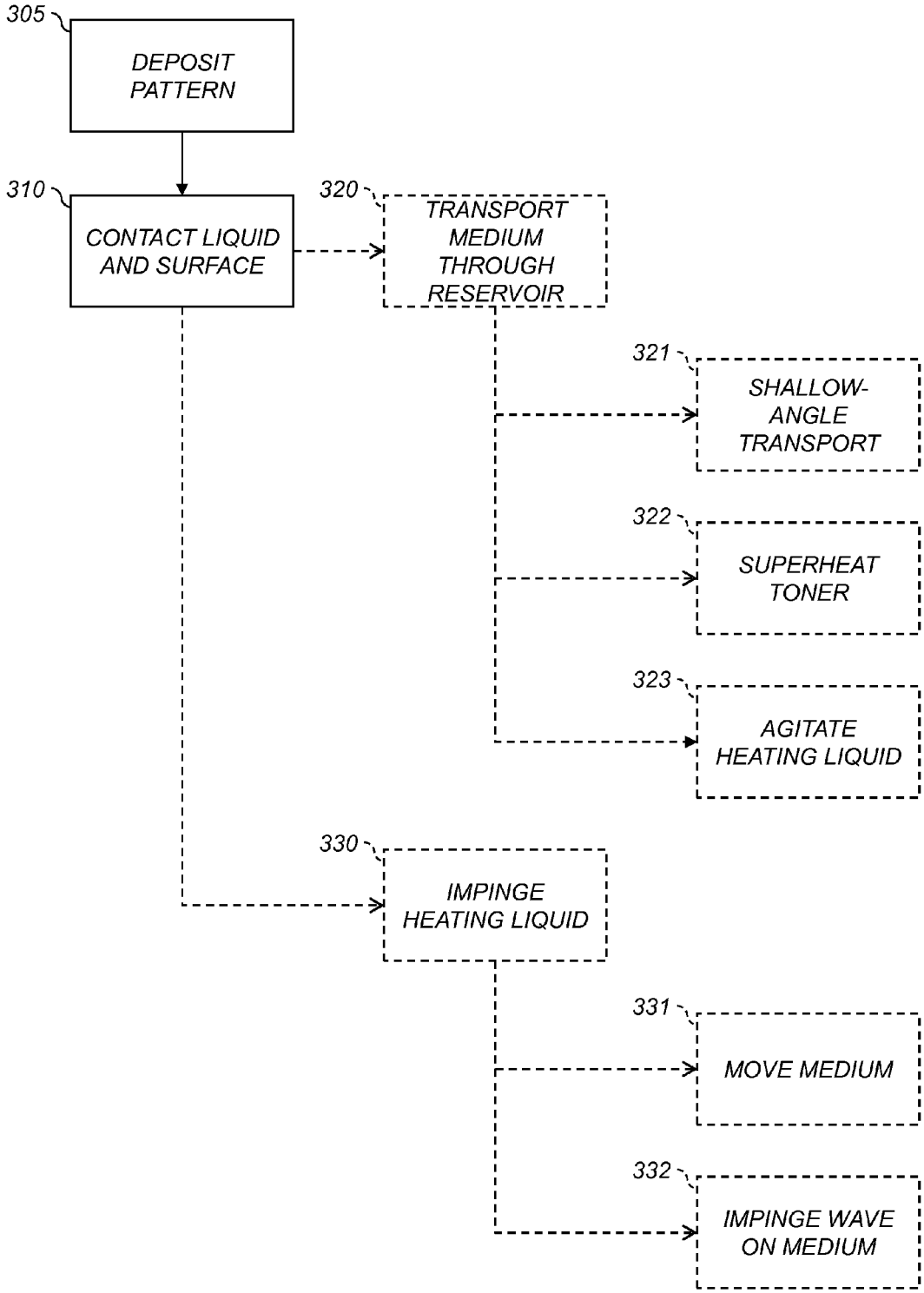
FIG. 3 is a flowchart of ways of fixing toner onto a receiver medium according to various aspects.

FIG. 3 shows ways of fixing toner onto a receiver medium according to various aspects. The toner has a toner glass transition temperature ($T_g$). Processing begins with deposit pattern step 305. An arrow with a triangular arrowhead connects a step to a step that can follow it. An arrow with an open arrowhead connects a step to a substep that step can include.

In deposit pattern step 305, a pattern of toner is deposited onto a surface of the receiver medium. The pattern can be a flood-fill or solid coat of some or all of the receiver, a screened pattern, an image, text, or any other pattern. Deposited toner is generally held to the receiver by van der Waals forces.

In contact liquid and surface step 310, at least one surface of the receiver medium is brought into contact with a heating liquid (e.g., heating liquid is applied to the surface). Throughout this disclosure, the term "contact," when used in reference to the receiver medium or a surface thereof being brought into contact with a substance or component, includes contact between that substance or component and toner on the receiver medium or surface. In this example, the term "contact" means that heating liquid can contact the receiver medium or toner thereon.

The heating liquid is warmed to a temperature greater than the toner glass transition temperature ($T_g$). As used herein, "a temperature greater than the toner glass transition temperature" includes "a temperature greater than a temperature of the toner," since if the heating liquid is not hotter than the toner, heat will not transfer from the heating liquid to the toner.

Since the heating liquid is hotter than the toner, and also warmer than the toner glass transition temperature, while the heating liquid and the surface are in contact, heat is transferred from the warmed heating liquid to the toner, raising the temperature of the toner to a level above the toner glass transition temperature. This reduces the Young's modulus of the toner, e.g., to the rubbery regime (10 MPa) or lower, to improve its adhesion to the receiver medium. Moduli are described in U.S. Pat. No. 5,968,700 to Tyagi et al., which is incorporated herein by reference. In various aspects, the heating liquid exerts pressure on the softened toner to press it towards the receiver medium. This further improves the strength of the bond between the softened toner and the receiver medium.

"Glass transition temperature" as used herein means the temperature or temperature range at which a polymer changes from a solid to a viscous liquid or rubbery state. Further details regarding the glass transition temperature ($T_g$) are described in U.S. Pat. No. 5,045,424 to Rimai et al., entitled "Thermally assisted process for transferring small electrostatographic toner particles to a thermoplastic bearing receiver," which is incorporated herein by reference. Many polymers exhibit a range of temperatures for $T_g$, depending on their chemical structure, orientation, or cooling rate. For example, styrene-acrylate copolymers can be used to form toners. In another example, the black toner for the KODAK DIGIMASTER production printer uses a styrene-butylacrylate polymer.

In various aspects, the heating liquid does not mix with or dissolve the toner. Examples of heating liquids largely or substantially immiscible with hydrophilic toners (e.g., polyester toners) include organic oils such as mineral oil or silicone oils, low-melting-point liquid metals such as mercury, Wood's metal, Rose's metal, or CERROSAFE, and molten waxes. Some silicone oils can absorb small amounts of moisture in the liquid or gaseous phases. In various aspects, a viscoelastic modifier is added to an oil heating liquid, as discussed below. In other aspects, the heating liquid is a mineral oil. In other aspects, the heating liquid is a silicone oil (e.g., DOT 5 brake fluid). In other aspects, the heating liquid is a mineral oil. In other aspects, the heating liquid is or includes a glycol or glycol ether (e.g., triethylene glycol monobutyl ether, which is a component of DOT 3 brake fluid).

In various aspects using liquid toners (toner marking particles in hydrophobic liquid), the heating liquid is a hydrophilic liquid such as water, alcohol, or glycol. Examples of those are given above.

Hydrophilic toners can include those which are wetted by water (e.g., polyester), or other hydrophilic liquids, such as low-molecular-weight alcohols or glycols such as those with four carbons or fewer, and liquid acids such as common low-molecular-weight organic acids (e.g., formic or acetic acid) and inorganic liquid acids (e.g., nitric or sulfuric acids). In various aspects, the heating liquid is substantially not absorbed by the receiver medium, either because of chemical composition or, as discussed below, because of moisture egress from the receiver medium. Toners that are plasticized by water or absorb water, but are dissolved by hydrophobic liquids, are considered herein to be hydrophobic toners.

In various aspects, heating fluids are used that are chemically incompatible with the toner and do not substantially absorb or plasticize the toner. With styrene-acrylate toners, the heating fluid can be polydimethylsiloxane (PDMS), an aliphatic oil such as ISOPAR, or a hydrophilic liquid such as water, a glycols, or an alcohol. In an example, water is used as a heating fluid to fix toner onto non-cellulose substrates (e.g., metal foils). With polyester toners, the heating fluid can be PDMS or an aliphatic oil such as ISOPAR. Hydrophilic liquids can interact with polyester toners, so are not preferred, although they can be used. With aliphatic (wax) based marking materials, such as wax-based toners or toners partially composed of wax (e.g., crayons or XEROX solid ink), the heating liquid can be a hydrophilic liquid as described above.

In various aspects, the temperature of the warmed heating liquid is less than a medium degradation temperature above which the medium irreversibly degrades. In various aspects, the temperature of the warmed heating liquid is less than a toner degradation temperature above which the toner irreversibly degrades. The toner degradation temperature can be determined based on the length of time toner is exposed to the heating liquid (e.g., while the receiver passes through a reservoir of heating liquid). In various examples, the toner degradation temperature is above 100° C.

Figure 7:
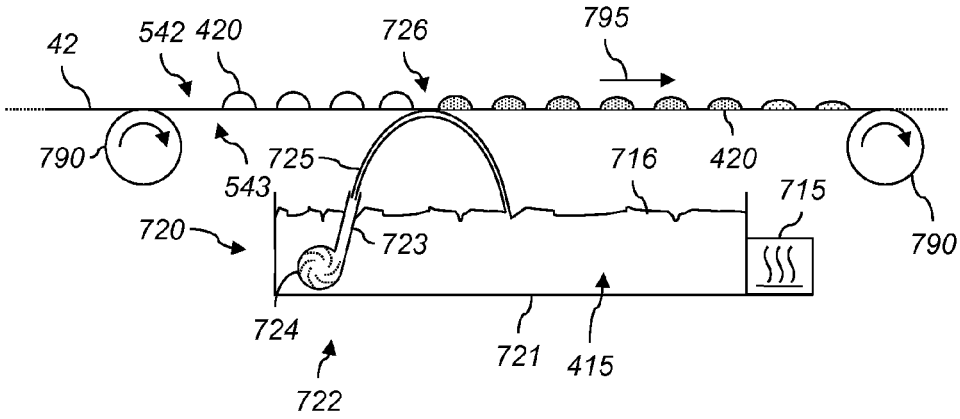

In various aspects, the temperature of the heating liquid is selected to provide a desired rate of moisture egress from the receiver medium. In an example, the heating liquid is at 150-200° C., and the heating liquid contacts the toner for approximately 10-50 milliseconds (e.g., using a fountain as shown in FIG. 7).

In various examples, the receiver medium is deliberately moistened with a liquid that does not mix with the heating liquid before the receiver medium is exposed to heating liquid. For hydrophobic heating liquids, hydrophilic liquid is applied. For hydrophilic heating liquids, hydrophobic liquid is applied. This resists ingress of the heating liquid into the receiver medium.

When the warm heating liquid is applied to the at least one surface of the receiver medium, the liquid matches its shape approximately to that of the surface. This provides effective contact and improved heat transfer compared to systems with air gaps. Moisture in the receiver can be boiled off by heat transferred from the warm heating liquid. This produces a concentration gradient of moisture from higher moisture content in the center of the receiver medium to lower moisture content at the surface in contact with the heating liquid. Moisture inside the receiver medium travels down this concentration gradient towards the surface. The result is a flow of moisture from the core to the edges and faces of the receiver medium. This flow reduces the probability of burning the outside of the receiver medium, and helps keep the heating liquid out of the interior of the receiver medium. Moreover, when the moisture boils, the resulting vapor bubbles exert pressure on the heating liquid to further assist in keeping the heating liquid out of the interior of the receiver medium. This is similar to deep frying, which is a dry-heat process.

In various aspects, liquid toner with a hydrophobic carrier liquid is used together with a hydrophilic heating liquid. In these aspects, the carrier liquid is selected to penetrate the receiver medium to a selected depth or extent. This hydrophobic liquid also advantageously resists penetration of the hydrophilic heating liquid into the receiver medium. Carrier liquid can be removed from the receiver medium, during or after fixing or softening of the toner, by heating the carrier liquid in the receiver to raise its vapor pressure.

In various aspects, the receiver medium is removed from the heating liquid before the moisture level of the receiver drops below ~1 wt.pct. This reduces the probability of heating liquid flowing into the receiver medium as the flow of moisture out reduces. The fixing process provided by the contact liquid and surface step 310 can result in the receiver medium having approximately 5 wt.pct. water.

In various aspects, the warmed heating liquid undergoes a phase change while heat is being transferred from the warmed heating liquid to the toner. The phase change releases heat so that at least a portion of the released heat contributes to fixing the toner. That is, the warmed heating liquid transfers heat to the relatively cooler toner in the receiver medium. In various aspects, the phase change is a liquid-to-solid phase change, or another exothermic phase change that releases heat. A liquid-to-solid phase change can transfer the latent heat of fusion into the toner without a significant temperature change. This can advantageously reduce the temperature delta between the toner and the heating liquid.

In a phase change, two phases of the same system with the same Gibbs free energy at the same conditions can change phase with a change in a given factor (e.g., temperature). In a first-order phase transition, the Gibbs free energy is constant but with discontinuous first derivative across the change. As energy is added to the system, its temperature does not increase since it takes a certain amount of energy to transition from one curve to the other curve according to the well-known Clausius-Clapeyron equation. In a second-order phase transition, the Gibbs free energy and its derivative are constant, but its second derivative is discontinuous. Adding energy at such a transition continues to raise the temperature of the system, but at a different rate. That is, the relationship between specific heat and temperature is not linear. No latent heat is present in these transitions. Other phase transitions can also be used.

In optional transport medium through reservoir step 320, which is part of contact liquid and surface step 310, the surface of the receiver medium is brought into contact with the heating liquid by transporting the receiver medium along a transport path through a reservoir containing the heating liquid. The receiver medium is thus submerged in the warmed heating liquid, which brings top and bottom surfaces of the receiver medium into contact with the heating liquid. The terms "top" and "bottom" do not restrict the orientation of the receiver medium, except as expressly described herein. The heating liquid can be in an open or closed container. The heating liquid can have a top surface at which it contacts air or another gas above it in the reservoir. Optional transport medium through reservoir step 320 is followed by optional agitate heating liquid step 323 and can include optional shallow-angle transport step 321 or optional superheat toner step 322.

In optional shallow-angle transport step 321, which is part of optional transport medium through reservoir step 320, the transport path transports the receiver medium into the reservoir at an angle of less than 15 degrees relative to the horizontal. This reduces the lateral force exerted on toner on the surface of the receiver medium as the receiver medium crosses through the top surface of the heating liquid in the reservoir. In various aspects, a pattern of toner is disposed on a first side of the receiver medium. The media-transport system transports the receiver medium into the reservoir with the first side oriented downward. In this way, the top surface of the heating liquid in the reservoir presses the toner into the receiver medium as the medium enters the heating liquid in the reservoir. This can reduce the probability of the top surface of the heating liquid exerting sufficient force on the toner particles to move them from the positions in which they were deposited, which can cause image artifacts.

In optional superheat toner step 322, which is part of optional transport medium through reservoir step 320, the heating liquid in the reservoir has higher temperature and pressure in a lower zone than in an upper zone above the lower zone. The transport path is configured so that the receiver medium passes through the lower zone, and the heating liquid in the lower zone is heated to a temperature above a boiling point of moisture in the receiver medium at an ambient pressure. The receiver medium is transported out of the reservoir into an environment at the ambient pressure. For example, if the receiver medium includes water that vaporizes at 100° C. at 1 atm and at 110° C. at the pressure in the lower zone, the heating liquid in the lower zone can be maintained at 108° C. As the receiver medium moves through the lower zone, the moisture in the receiver medium is heated to 108° C. After leaving the lower zone, the medium moves through cooler heating liquid (e.g., a gradient from 108° C. down to 99° C. at the top surface) and the moisture therein cools down. The receiver medium is moved at a speed sufficiently fast that the moisture therein does not cool below its ambient boiling point (e.g., 100° C.) before it reaches the top surface. Upon reaching the top surface, or a shallow enough region in the heating liquid to permit the moisture to boil at its then-current temperature, the moisture vaporizes and moves away from the medium. The resulting bubbles do not mechanically disturb the toner as they would if they occurred deeper in the heating liquid, and the approximate location at which bubbles will develop is controlled.

In this way, heating the toner under higher pressure reduces the Leidenfrost effect (see FIG. 18) by suppressing vapor formation from heating the receiver (e.g., reducing steam bubble formation). Vapor would form an undesirable gas layer substantially lower in thermal conductivity than the heating liquid or the receiver medium, reducing the effective heat transfer to the receiver medium and the toner thereon. Also, a vapor layer or bubbles can produce locally non-uniform shear stress to the toner image either before or after softening and fixing, possibly distorting the toner image.

In optional agitate heating liquid step 323, pressure is applied to at least some of the heating liquid in the reservoir using a mechanical transducer (e.g., an ultrasonic transducer) while the receiver medium is in the reservoir. The applied pressure transports a first volume of liquid away from the receiver medium. A second volume of liquid having a temperature higher than a temperature of the first volume of liquid is moved into proximity with the receiver medium. The pressure wave in the heating liquid can have a component normal to the receiver or a component transverse to the receiver, or both.

In optional impinge heating liquid step 330, which is part of contact liquid and surface step 310, the surface of the receiver medium is brought into contact with the heating liquid by using a liquid-delivery system to impinge the warmed heating liquid onto at least one surface of the receiver medium. In various aspects, the liquid-delivery system is a spraying system for spraying the warmed heating liquid onto at least one surface of the receiver medium. In various aspects, the liquid-delivery system is a curtain-coating system that includes a slit through which the warmed heating liquid flows, thereby forming a liquid curtain which impinges onto a top surface of the receiver medium. The term "top surface" is used for convenience and does not constrain the orientation of the receiver medium or the liquid curtain. For example, the receiver medium can be moving almost vertically downward, and the curtain can be falling down on a path converging with the path of the moving receiver.

In optional move medium step 331, which is part of optional impinge heating liquid step 330, the liquid curtain moves at a liquid-curtain speed in a liquid-curtain direction. In this step, the receiver medium is moved so that the liquid curtain impinges on the moving receiver medium in a coating region and the speed component in the liquid-curtain direction of the moving receiver medium is less than (i.e., has a lesser magnitude than) the liquid-curtain speed at a selected point in the coating region where the liquid curtain contacts the surface of the receiver medium. This difference in speed (i.e., the magnitude of the velocity difference, denoted $\Delta V$, where positive $\Delta V$ values indicate that the heating liquid is moving faster than the receiver medium) can introduce turbulent flow, which improves heat transfer.

Compared to a smaller $\Delta V$, a larger $\Delta V$ can provide improved heat transfer but at a risk of greater image degradation by moving the toner (marking liquid). Furthermore, as $\Delta V$ increases, the heating liquid tends to pile up on the receiver medium because of the drag on the heating liquid from the medium. A larger $\Delta V$ thus provides more pressure to counteract the vapor pressure of evaporated toner, as is discussed below with respect to FIG. 18. A larger $\Delta V$ also corresponds to a thicker pile of heating liquid, which means more heat is available to transfer to the toner. The value of $\Delta V$ can be selected empirically to balance these factors. The $\Delta V$ that can be used without causing unacceptable image degradation is limited by the viscoelasticity of marking liquid. A more viscoelastic material can tolerate more $\Delta V$ without being disrupted. The $\Delta V$ budget also depends on the thickness of the marking liquid on the medium, and the coverage of marking liquid over the medium.

In other aspects, where the warmed heating liquid impinges on the moving receiver medium, the component of velocity of the warmed heating liquid in the liquid curtain in the direction of motion of the receiver medium is substantially equal to the velocity of the receiver medium in that direction. That is, $\Delta V \approx 0$, or $\Delta V$ is within 20% of the liquid-curtain speed.

In optional impinge wave on medium step 332, which is part of optional impinge heating liquid step 330, the liquid-delivery system includes a tank supplied with warmed heating liquid. A wave-forming system forms a stationary wave on a top surface of the warmed heating liquid in the tank. The stationary wave can be a standing wave or a continuous laminar-flow fountain or curtain. The stationary wave can also be a low-pressure flow of heating liquid spilling out of a reservoir with a controlled spillway. A media-transport system transports the receiver medium over the top of the warmed heating liquid so that peaks of the stationary wave impinge on a bottom surface of the receiver medium. The term "bottom" does not constrain the orientation of the medium.

In various aspects, the heating liquid is a straight-chain hydrocarbon. After applying heating liquid to the receiver medium, a thin layer of heating liquid can adhere to the receiver medium. The temperature of the heating liquid can be selected so that if this occurs the vapor pressure of the heating liquid in that layer is high enough that the heating liquid in the layer readily evaporates off the receiver medium. In various aspects, residual heating liquid is removed from the receiver by heating, blowing with pressurized air, or applying vacuum. This advantageously reduces constraints on the temperature of the heating liquid.

Figure 4:
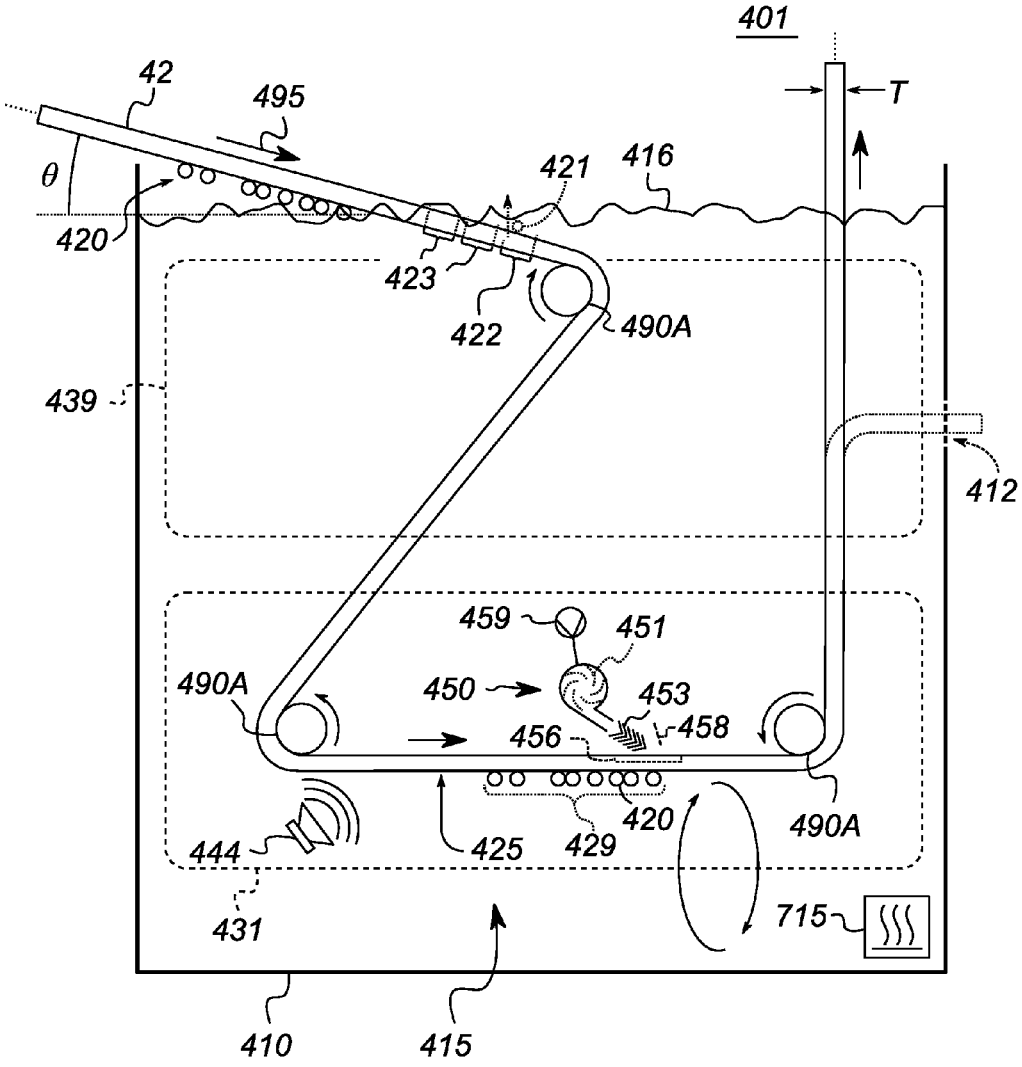
FIGS. 4-7 show toner fixing systems for fixing toner onto a receiver medium according to various aspects.

FIG. 4 shows an exemplary toner fixing system for fixing toner 420 onto receiver medium 42 according to various aspects. Toner 420 (toner particles represented graphically as circles) has a toner glass transition temperature ($T_g$). Reservoir 410 contains heating liquid 415 with top surface 416, represented graphically by a wavy line. Liquid-heating system 715 (represented graphically) warms heating liquid 415 in reservoir 410 to a temperature greater than the toner glass transition temperature. Additional details of liquid-heating system 715 are described below. A media-transport system transports receiver medium 42 along transport path 495, which passes through reservoir 410. Therefore, as the receiver medium 42 is transported along the transport path 495 it is submerged in the warmed heating liquid 415. Heat is thus transferred from the warmed heating liquid 415 to the toner 420, thereby raising a temperature of toner 420 to a level above the toner glass transition temperature. This softens the toner 420 and fixes it onto the receiver medium 42. In various aspects, receiver medium 42 is a porous or semi-porous medium. In the example shown, the receiver medium 42 is a web and the media-transport system includes three rotatable members 490A (e.g., belts or rollers) around which receiver medium 42 is entrained.

In various aspects, heating liquid 415 is immiscible with toner 420. For example, toner 420 can be hydrophilic and heating liquid 415 can be an organic or silicone oil. In various aspects, heating liquid 415 is substantially not absorbed by receiver medium 42. For example, warm tar can be used as a heating liquid, and the receiver can be a semi-porous paper. The high molecular weight, and thus large size, of the molecules in the tar increases its viscosity and the work required to make it flow, which substantially restricts the extent to which those molecules can permeate the receiver. In an example, the tar is fluorinated to decrease its surface energy. This reduces forces of adhesion between the tar and receiver medium 42. The high viscosity of the tar reduces the probability that the tar will wet receiver medium 42 during the brief time the tar and the receiver are in contact. As a result of the reduced adhesion forces, any tar that does wet receiver medium 42 will not require much energy to remove from the receiver. In other aspects, heating liquid 415 is a liquid metal, which has a very high surface energy.

In other aspects, receiver medium 42 is newsprint or another paper that is substantially 100% cellulose fibers. (This is in contrast to bond paper, which typically includes cellulose fibers and barium titanate or titanium dioxide brighteners, among other surface treatments.) Heating liquid 415 is warm tar, oxygenated or otherwise treated to increase its surface energy above the surface energy of receiver medium 42. As a result, the tar substantially does not wet the paper. Cellulose fibers can have a surface energy of approximately 45 erg/cm$^2$. Non-fluorinated tar can have a surface energy of approximately 35 erg/cm$^2$. Treating the tar to raise its surface energy above ~45 erg/cm$^2$ causes the tar (heating liquid 415) not to wet the paper (receiver medium 42). These aspects are not used with receiver media 42 containing significant amounts of brighteners. Both barium titanate and titanium dioxide are significantly polarizable under appropriate conditions, so both can increase the surface energy of receiver medium 42 beyond a level that can be exceeded by oxygenating tar (e.g., beyond 72 erg/cm$^2$, the surface energy of water).

The surface energy is the amount of energy required to be added to a mass of material to increase its surface area by 1 cm$^2$. Liquids will generally not wet surfaces they contact if the liquids have higher surface energy than the surfaces. In some examples above of fluorinated tar, since it is difficult to increase the surface energy of the tar above that of paper with brighteners, viscosity can be used to reduce wetting of the paper and low surface energy can reduce adhesion. In some examples above of oxygenated tar, high surface energy can substantially inhibit wetting, so adhesion substantially does not take place.

In another example, a partially cross-linked liquid can be used, or a mixture of a cross-linked and non-cross-linked fluid, in order to impart some degree of elasticity to the heating liquid, for example, motor oil with an STP oil treatment (a mixture of mineral oil, petroleum distillates, and zinc) added. The cross-linked liquid has large enough molecular weight that it does not readily flow and penetrate the receiver medium. In another example, mercury can be used with a porous or semi-porous paper receiver. Mercury will generally not wet such papers.

In various aspects, a small amount of a miscible viscoelastic liquid modifier is added to heating liquid 415. For example, adding a shear-thickening fluid similar in behavior to SILLY PUTTY silicone (which can include dimethyl siloxane, glycerin, boric acid, $TiO_2$, crystalline silica, or THIXOTROL ST, CAS 51796-19-1) to heating liquid 415 can reduce the flow of heating liquid 415 into receiver medium 42 when receiver medium 42 is moving quickly and producing significant shear forces or rates between the receiver medium 42 and the heating liquid 415. However, heating liquid 415 is still permitted to flow under lower shear, so it can be heated, pumped, and spread across the receiver medium 42. Heating liquid 415 with the liquid modifier can be removed from receiver medium 42 in a relatively higher shear stress geometry than when receiver medium 42 contacts heating liquid 415. The higher-shear-stress geometry causes the fluid to exhibit a higher consistency and therefore to be easier to strip from the receiver.

In various aspects, the temperature of warmed heating liquid 415 is less than a medium degradation temperature above which the medium 42 irreversibly degrades. In an example, receiver medium 42 is paper and heating liquid 415 is at a temperature less than the autoignition temperature of the paper (e.g., 451° F.). In another example, receiver medium 42 includes a thermoplastic polymer, and the temperature of heating liquid 415 is less than a temperature at which the thermoplastic polymer will soften to the point that it undergoes plastic deformation while being transported by the media-transport system.

Pigment can be carried in separate particles in toner 420. Toner can be formulated with either hydrophilic or hydrophobic polymers as the binder (e.g., polyester or styrene acrylate, respectively). In order to minimize irreversible softening of the toner by plasticizing with a compatible liquid, the heating liquid generally should be chosen such that its hydrophobicity is the opposite of the toner type, therefore generally being a less compatible pairing. Absorption of a compatible liquid into the polymer binder can lower the $T_g$ of the polymer, can somewhat increase mobility of polymer chain segments at lower temperatures, and can lower the polymer modulus, thereby making the binder more compliant. Unless the absorbed liquid is removed (e.g., by heating) from the polymer, it can make the toner undesirably soft, leading to image degradation by, for example, smearing, sticking or transfer of toner to non-image areas of receiver medium 42. Therefore, in various aspects, hydrophobic liquids are used with hydrophilic toners, or hydrophilic heating liquids are used with hydrophobic toners. Heating liquid 415 can be an aliphatic hydrocarbon, or low-molecular-weight polydimethylsiloxane (PDMS). Heating liquid 415 can also be an ISOPAR (e.g., ISOPAR-M or ISOPAR-K). Heating liquid 415 can be hydrophobic, such as a liquid hydrocarbon (e.g., octane, pentane, heptane, butane, or propane), anhydrous ammonia, Woods metal, bismuth alloy. In various aspects, while the toner on the receiver medium is submerged in the warmed heating liquid, hydrophobic heating liquid 415 further softens the toner by plasticizing it.

For polymeric heating liquids 415, the molecular weight can be selected to provide a boiling point in a desired range. Higher molecular weight can correlate with a higher boiling point. In various examples, heating liquid 415 is selected to have a vapor pressure low enough that heating liquid 415 is substantially liquid, and not gaseous, at a desired heating temperature above the toner glass transition temperature of toner 420. In various aspects, oxygen concentration in heating liquid 415 is kept low to reduce the probability that toner 420 will ignite at the heating temperature.

In various aspects, the media-transport system transports receiver medium 42 into reservoir 410 at an angle θ of less than 15° relative to the horizontal. This reduces the effect on toner 420 of bubbles of vaporized moisture from receiver 42 traveling up through heating liquid 415. Angle θ can be selected so that bubbles 421 of vaporized moisture do not significantly disturb adjacent areas of toner.

In an example, the receiver medium 42 is 20 lb. bond paper, which has a thickness T of approximately 0.0038" (96.5 μm). Toner is deposited in engine-pixel areas 422, 423 at 600 dpi (0.0236 dpμm), i.e., 42.3 μm on a side. Assuming that bubble 421 emerges from receiver 42 laterally centered in engine-pixel area 422, it is desirable that the bubble 421 be laterally confined within the area 422 to reduce disruption of toner in adjacent areas 423. The maximum lateral offset of bubble 421 should therefore be half an engine pixel, or 21.2 μm (from the center to edge of area 422), over a travel through receiver medium 42 of 96.5 μm (through the medium from bottom to top along the path a bubble can travel, neglecting the increase in travel distance due to the tilt of the medium since that tilt is small). The resulting angle is 0.216 rad≈12.4° off the normal to the receiver medium. Therefore, if the receiver medium is tilted less than 12.4° away from the horizontal, a bubble from the center of area 422 travelling up will not disrupt toner in an adjacent area 423. In another example, receiver medium 42 has a thickness of 79.0 μm and, at 600 dpi, an angle of 15° is used.

In various aspects, receiver medium 42 includes a pattern 429 of toner 420 on first side 425 of receiver medium 42. In the example shown, toner 420 near engine-pixel areas 422, 423 can also be part of pattern 429.

In various aspects, the media-transport system transports the receiver medium 42 through reservoir 410 with first side 425 oriented downward. In this way, heating liquid 415 that transfers heat to toner 420 in pattern 429 surrenders heat. This relatively cooler heating liquid 415 above hotter heating liquid 415 can establish convective circulation, as shown by the elliptical arrows, that will replace the cooler heating liquid 415 near pattern 429 with fresh, hotter heating liquid 415 from lower in reservoir 410. First side 425 can be the side most recently printed. Orienting first side 425 downward permits the fresh heating liquid 415 circulating from below to directly contact the freshly-printed surface, improving fixing performance.

In various aspects (not shown), receiver medium 42 is transported in upper zone 439 and not in lower zone 431. This permits taking advantage of the heat rising through reservoir 410, keeping the temperature of upper zone 439 high. In other aspects, the top and right rotatable members 490A are used and the left is not. Receiver medium 42 descends quickly into lower zone 431, then returns quickly through upper zone 439 (shown at the right-hand side of reservoir 410). During the return, the temperature of heating liquid 415 rises approaching top surface 416. This permits heat to continue to be transferred into toner 420, even as receiver medium 42 heats up in heating liquid 415.

In various aspects, the heating liquid 415 in reservoir 410 includes lower zone 431 and upper zone 439 above lower zone 431. Heating liquid 415 has higher temperature and pressure in lower zone 431 than in upper zone 439. The media-transport system is configured so that receiver medium 42 passes through lower zone 431, in which heating liquid 415 is heated to a temperature above a boiling point of the heating liquid at an ambient pressure. The media-transport system transports receiver medium 42 out of reservoir 410 into environment 401 at the ambient pressure. In various examples, if some heating liquid 415 has wetted the receiver medium 42 under high pressure in lower zone 431, when the receiver medium 42 emerges into the relatively lower-pressure environment 401, it is above its boiling point at that pressure. As a result, it evaporates off cleanly. Vapor catchers can be used to capture the evaporated heating liquid 415.

Moreover, the high pressure in lower zone 431 exerts greater force on vapor bubbles that escape receiver medium 42 in lower zone 431 than on those in upper zone 439. These bubbles can exhibit the Leidenfrost effect under appropriate temperature conditions, whereby the bubbles remain close to receiver medium 42, insulating it from heating liquid 415. The high pressure can compress the Leidenfrost layer, improving heat transfer from heating liquid 415 to receiver medium 42. This is discussed below with reference to FIG. 18. The high pressure advantageously improves heat transfer to toner 420 on receiver 42.

In various aspects, a mechanical transducer 444 applies pressure to at least some of the heating liquid 415 in reservoir 410 while the receiver medium 42 is in the reservoir 410. The transducer 444 is represented graphically by a loudspeaker symbol, since transducer 444 can include a moving membrane. Transducer 444 can also include an impeller or piezoelectric actuator. The waves of pressure produced in heating liquid 415 by transducer 444 are represented graphically as arcs. When a pressure wave nears the receiver medium 42, a first volume of liquid is transported away from the receiver medium 42 by the applied pressure and a second volume of liquid having a temperature higher than a temperature of the first volume of liquid is moved into proximity with receiver medium 42. That is, agitation of heating liquid 415 by transducer 444 moves heating liquid 415 that has already transferred heat to receiver medium 42 away from receiver medium 42 so that fresh, hot heating liquid 415 can transfer heat into toner 420.

In various aspects, a pressurizer 450 in the reservoir 410 produces a jet 453 of heating liquid 415. Jet 453 (represented graphically as a series of arrowheads) impinges on receiver medium 42 in pressure zone 456. Moisture in receiver 42 in the pressure zone 456 is heated above its boiling point and remains liquid due to the higher pressure. When the motion of the receiver medium 42 carries such heated moisture out of the pressure zone 456, such moisture vaporizes. This permits controlling where vapor is formed in reservoir 410, and thus where bubbles are formed.

Pressurizer 450 can include an impeller 451 and nozzle, as shown, or an airfoil, baffle (e.g., at 90° to the transport direction of receiver medium 42), or other deflector arranged to direct heating liquid 415 towards moving receiver medium 42. The term "jet" does not require an active element. In an example, the moving receiver medium 42 drags heating liquid 415 with it, and pressurizer 450 is a fixed vane angled closer to the moving receiver medium 42 in the downstream direction. This vane compresses the moving heating liquid 415 close to the moving receiver medium 42. In various aspects, fixed vanes are used to agitate the heating liquid 415 moving with receiver medium 42.

In various aspects, pressurizer 450 includes a plenum (represented graphically as the circle around the impeller blades) having an outlet (represented as the tube extending from the impeller housing) directed towards pressure zone 456, and pump 459 to supply heating liquid 415 under pressure through the plenum. In various aspects, pressurizer 450 includes impeller 451 and directing member 458 fixed in position in reservoir 410. Impeller 451 directs heating liquid 415 towards directing member 458, and directing member 458 directs the impelled heating liquid 415 in jet 453 towards pressure zone 456.

In various aspects, the media-transport path transports the receiver medium 42 into and out of reservoir 410 through an interface surface (here, top surface 416; in general, where heating liquid 415 meets another fluid with which it is substantially immiscible, e.g., a gas such as air) of heating liquid 415 in reservoir 410. In other aspects, the media-transport path transports receiver medium 42 into or out of reservoir 410 through a slit 412 in a surface of the reservoir 410. This is represented graphically by the dotted-line path extending through the side of the reservoir 410. Preferably, the slit 412 is no more than twice the thickness of the receiver medium 42. That slit 412 is so thin that it resists flow through slit 412, so that heating liquid 415 substantially does not drain out of reservoir 410. Heating liquid 415 that does exit reservoir 410 through slit 412 can be captured and returned to reservoir 410 (e.g., using a pump).

In various aspects, warmed heating liquid 415 undergoes a phase change while heat is being transferred from warmed heating liquid 415 to toner 420. The phase change releases heat so that at least a portion of the released heat contributes to fixing toner 420. In various examples, the phase change is a liquid-to-solid phase change, or another exothermic phase change that releases heat. Phase changes are described above.

Figure 5:
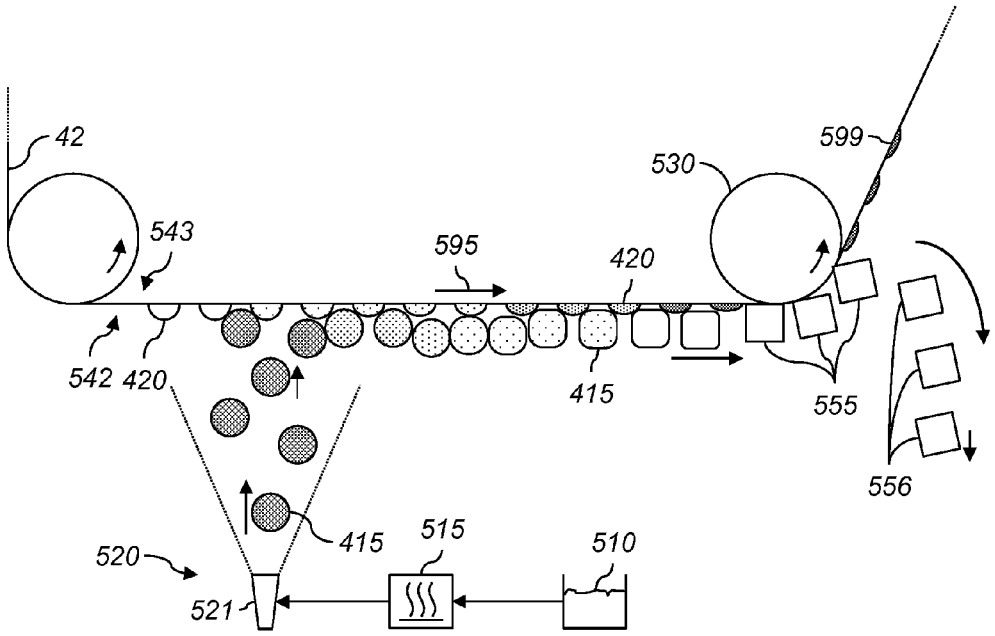

FIG. 5 is an elevation of an exemplary toner fixing system for fixing toner 420 onto receiver medium 42 according to various aspects. Toner 420, represented graphically by semi-ellipses on surface 542 of receiver medium 42, has a toner glass transition temperature. Receiver medium 42 can be cut sheets on a belt, or can be a web of material. (Here and throughout this disclosure, portions of belts or webs, or drums or other devices for bearing and guiding belts or webs, are sometimes omitted from the drawings for clarity.) The receiver medium 42 is transported along transport path 595 by appropriate media transport mechanisms, which can include belts, rollers and motors.

Liquid-supply system 510 provides heating liquid 415, represented graphically by circles and rounded rectangles. Liquid-supply system 510 can include a tank, a reservoir (represented graphically in this example), a pump (peristaltic, impeller, or otherwise), an Archimedes screw, or any other liquid-storage or -transfer device. Liquid-heating system 515 warms heating liquid 415 to a temperature greater than the toner glass transition temperature, and can include a resistive or inductive heater, a burner, a pipe carrying hot steam, a heat exchanger, or other heating devices. Throughout this disclosure, liquid-supply system 510 and liquid-heating system 515 can be components of a single unit that supplies heating liquid 415.

Throughout this disclosure, systems for adding heat to heating liquids can include: irradiation devices such as IR lamps or microwave or RF sources; inductive heaters; devices that arrange heat-supply fluids such as air, various gases, or liquids with respect to heating fluids to transfer heat from the heat-supply fluids to the heating fluids; or rollers arranged to transfer heat to heating fluids. Such rollers can be internally or externally heated, and can be made, for example, of aluminum (coated with oxide or release layer or agent), of thin layer(s) of thermally-conductive elastomers adhered to a solid support core, or of such thermally-conductive layer(s) with additional coating layer(s). The additional coating layer(s) can include compounded fluorinated material as binder such as thermoplastic fluoroplastics (e.g., TEFLON or PFA (perfluoroalkoxy)), or thermoset flouroelastomers such as VITON, or a combination thermoplastic flouropolymer/silicone interpenetrating network. Optional additional fillers can be added to increase thermal conductivity (metals, carbon, metal oxides), or electrical conductivity (metals, carbon, metal oxides). Metallic oxides can include homogeneous (single) metallic elements as oxides with integral or fractional stoichiometric ratios with oxygen to form various oxides, e.g., include zinc oxide (ZnO), cuprous oxide ($Cu_2O$), combination of titanium oxides with lower oxidation states than TiO2 (such as TiO and $TiO_2$, denoted $TiO_{2-x}$), combination of ferric and ferrous oxide ($Fe_2O_3$ and $Fe_3O_4$), indium oxide (InO), and tin oxide ($SnO_2$). Combinations of various metallic element oxides can be used for conductivity, such as the combination of indium and tin oxide to improve electrical conductivity.

Liquid-delivery system 520 impinges warmed heating liquid 415 onto surface 542 of receiver medium 42. As a result, heat is transferred from heating liquid 415 to toner 420, thereby raising a temperature of toner 420 to a level above the toner glass transition temperature thereof. This softens toner 420, fixing it or assisting in fixing it onto receiver medium 42.

In various aspects, the liquid-delivery system 520 includes spraying system 521 (which can include, for example, an atomizer or a high-pressure pump) for spraying warmed heating liquid 415 onto surface 542 of receiver medium 42. For clarity, not all drops of toner 420 or of heating liquid 415 are labeled.

In the example shown, relative heat is represented graphically by the relative density of hatch marks on each drop of heating liquid 415. Initially, drops of heating liquid 415 are warmer than particles of toner 420. This is represented by dense hatching on heating liquid 415 and the absence of hatching on toner 420. As heat is transferred, toner 420 gains heat (is shaded darker) and heating liquid 415 loses heat (is shaded lighter or not at all). Softening of toner 420 as its temperature increases is represented graphically by a decreasing thickness of the ellipses. In an example, drop 599 is entirely softened; all the toner particles in toner 420 are above the glass transition temperature by the time receiver medium 42 reaches this point along the transport path 595.

In various aspects, receiver medium 42 includes a front surface (here, surface 542) and an opposing back surface (surface 543). The terms "front" and "back" do not constrain the orientation of receiver medium 42. Unfixed toner 420 is present on front surface 542. In the configuration shown in FIG. 5, the heating liquid 415 impinges onto the front surface (surface 542) of receiver medium 42. In other configurations, the heating liquid 415 can impinge onto the non-printed back surface (surface 543) of receiver medium 42. This has the advantage that the impinging heating liquid 415 is less apt to disturb a printed pattern of toner 420, although the rate of heat transfer to the toner 420 will generally be somewhat lower.

In various aspects, the heating liquid 415 is substantially not absorbed by receiver medium 42 or toner 420. In various aspects, the temperature of the warmed heating liquid 415 is less than a medium degradation temperature above which the medium 42 irreversibly degrades. In various aspects, the temperature of warmed heating liquid 415 is less than a toner degradation temperature above which toner 420 irreversibly degrades.

In various aspects, warmed heating liquid 415 undergoes a phase change while heat is being transferred from warmed heating liquid 415 to toner 420. The phase change releases heat such that at least a portion of the released heat contributes to raising the temperature of toner 420. Phase changes are described above. In an example, the phase change is from liquid to solid. Liquid drops of heating liquid 415 are represented graphically as circles. Solidified drops of heating liquid 415 (solidified heating liquid 555) are represented graphically as rectangles. Drops of heating liquid 415 represented graphically as rounded rectangles are in the process of solidifying.

In various aspects, at least some of the heating liquid 415 is solid after the phase change, as shown by solidified heating liquid 555. Receiver medium 42 travels along transport path 595 arranged so that solidified heating liquid is dislodged from receiver medium 42 as it undergoes a change in surface orientation. Changes in surface orientation include changes in the direction of the normal vector or surface area of surface 542. Examples include traveling around a roller 530 (shown), twisting out of the plane of surface 542, or stretching in the plane of surface 542. All of these changes in surface orientation exert force that assists in breaking solidified heating liquid 555 off surface 542. In this example, solidified heating liquid 555 does not bend as medium 42 travels around roller 530. As a result, drops or particles of solidified heating liquid 555 detach from receiver medium 42, forming particles or flakes of detached solidified heating liquid 556. These can be vacuumed, blown, or electrostatically or magnetically forced away from medium 42, or can be permitted to fall under the influence of the Earth's gravity (as shown). In an example (not shown), receiver medium 42 is twisted through 90° from a horizontal orientation, while heating liquid 415 is applied to it, to a vertical orientation, which permits gravity to pull detached solidified heating liquid 556 off receiver medium 42, away from drop 599.

In other aspects, heating liquid 415 is a super-saturated aqueous solution of sodium sulfate or another fluid that can release a significant amount of heat quickly. The solute in such a solution releases heat as the solution solidifies when the supersaturation becomes unstable. In other aspects, heating liquid 415 is a chemically-homogeneous material, e.g., wax, that can release heat while crystallizing. In other aspects, heating liquid 415 includes a secondary component dissolved or suspended in the liquid. The secondary component crystallizes, releasing heat. An example is a liquid-liquid suspension of a liquid waxy crystalline material in an immiscible hydrocarbon solvent.

Figure 6:
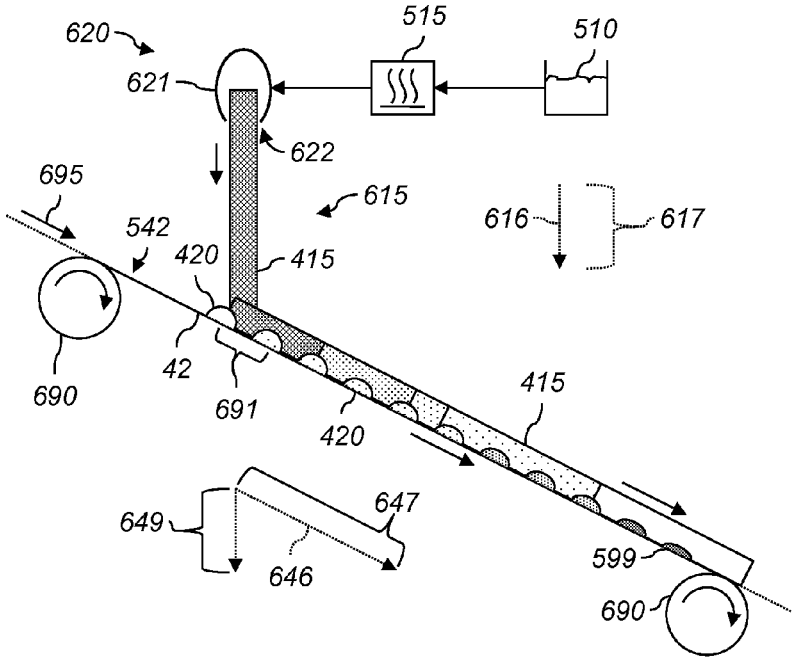

FIG. 6 is an elevation of an exemplary toner fixing system for fixing toner 420 onto receiver medium 42 according to various aspects. Moving receiver medium 42, toner 420, surface 542, liquid-supply system 510, heating liquid 415, and liquid-heating system 515 are as shown in FIG. 5. The receiver medium 42 travels along a transport path 695. A liquid-delivery system 620 includes curtain-coating system 621. Curtain-coating system 621 includes slit 622 through which warmed heating liquid 415 flows, thereby forming liquid curtain 615 that impinges on surface 542 of receiver medium 42. Liquid curtain 615 is represented graphically by various connected rectangles, hatched to represent heat as discussed above with reference to FIG. 5. Receiver medium 42 can be oriented in any way with respect to liquid curtain 615, provided heating liquid 415 impinges on surface 542. In various aspects, liquid curtain 615 impinges in a substantially vertical direction onto surface 542 of receiver medium 42.

In various aspects, when liquid curtain 615 contacts surface 542 of receiver medium 42, liquid curtain 615 has liquid-curtain speed 617 in liquid-curtain direction 616. For clarity, all speeds and directions are shown as dotted-line vectors, the length shown being proportional to the speed (arbitrary units).

A media-transport system (including rotatable transport members 690) transports receiver medium 42 so that liquid curtain 615 impinges on receiver medium 42 in coating region 691. (Liquid curtain 615 can also contact receiver medium 42 downstream of coating region 691.) In coating region 691, receiver medium 42 has medium-transport speed 647 in medium-transport direction 646. In various aspects, curtain-coating system 621 and the media-transport system are arranged so that speed component 649 in liquid-curtain direction 616 of transported receiver medium 42 is within ±20% of liquid-curtain speed 617 at a point where liquid curtain 615 contacts surface 542 of receiver medium 42. This can reduce damage to the image in coating region 691, since the liquid curtain does not experience a significant change in vertical speed. Such a change would cause shear and turbulence in liquid curtain 615, possibly degrading a printed image by moving the toner 420. In other aspects, speed component 649 is less than liquid-curtain speed 617 at a point where liquid curtain 615 contacts surface 542 of receiver medium 42. These aspects are further discussed above with reference to step 331 (FIG. 3).

In various aspects, warmed heating liquid 415 undergoes a phase change while heat is being transferred from warmed heating liquid 415 to toner 420, as described above. The phase change releases heat such that at least a portion of the released heat contributes to raising the temperature of toner 420. For cases where a liquid-to-solid phase change occurs, the solidified heating liquid 555 (FIG. 5) can be dislodged from the medium 42 using methods such as those discussed earlier with reference to FIG. 5.

FIG. 7 is an elevation of an exemplary toner fixing system for fixing toner 420 onto receiver medium 42 according to various aspects. Receiver medium 42, toner 420, surfaces 542 and 543, and heating liquid 415 are as shown in FIG. 5. The receiver medium 42 travels along a transport path 795.

A liquid-delivery system 720 includes a tank 721 (part of the liquid-supply system) supplied with warmed heating liquid 415. Liquid-heating system 715 keeps heating liquid 415 in tank 721 warm. Wave-forming system 722, in this example nozzle 723 fed by pump 724, forms stationary wave 725 on top surface 716 of warmed heating liquid 415 in tank 721. Other methods for forming a stationary wave 725 on the surface of a liquid are well-known in the wave-soldering art. Any such method can be used.

A media-transport system, in this example including rotatable members 790 (e.g., belts or drums), transports receiver medium 42 along transport path 795 over the top of warmed heating liquid 415 so that one or more peak(s) of stationary wave 725 impinge on a lower surface (surface 543) of receiver medium 42. Unfixed toner 420 is present on an opposing upper surface (surface 542) of receiver medium 42. Heat is transferred through receiver medium 42 to toner 420. The hatching of toner 420 represents those drops gaining heat when passing peak 726, and the height of the drops represents toner 420 softening and the drops gradually cooling in the air or other gas around them.

In various aspects, warmed heating liquid 415 undergoes a phase change while heat is being transferred from warmed heating liquid 415 in stationary wave 725 to toner 420. The phase change releases heat such that at least a portion of the released heat contributes to raising the temperature of toner 420, as described above. The phase change can be a liquid-to-solid phase change, or another exothermic phase change that releases heat. In various aspects, at least some of the heating liquid is solid after the phase change. Receiver medium 42 travels along a transport path arranged so that solidified heating liquid is dislodged from the receiver medium as it undergoes a change in surface orientation. This is discussed above with respect to FIG. 5.

In various aspects, heating liquid 415 is substantially not absorbed by receiver medium 42 or toner 420. In various aspects, the temperature of warmed heating liquid 415 is less than a medium degradation temperature above which receiver medium 42 irreversibly degrades. In various aspects, the temperature of warmed heating liquid 415 is less than a toner degradation temperature above which toner 420 irreversibly degrades.

Figure 8:
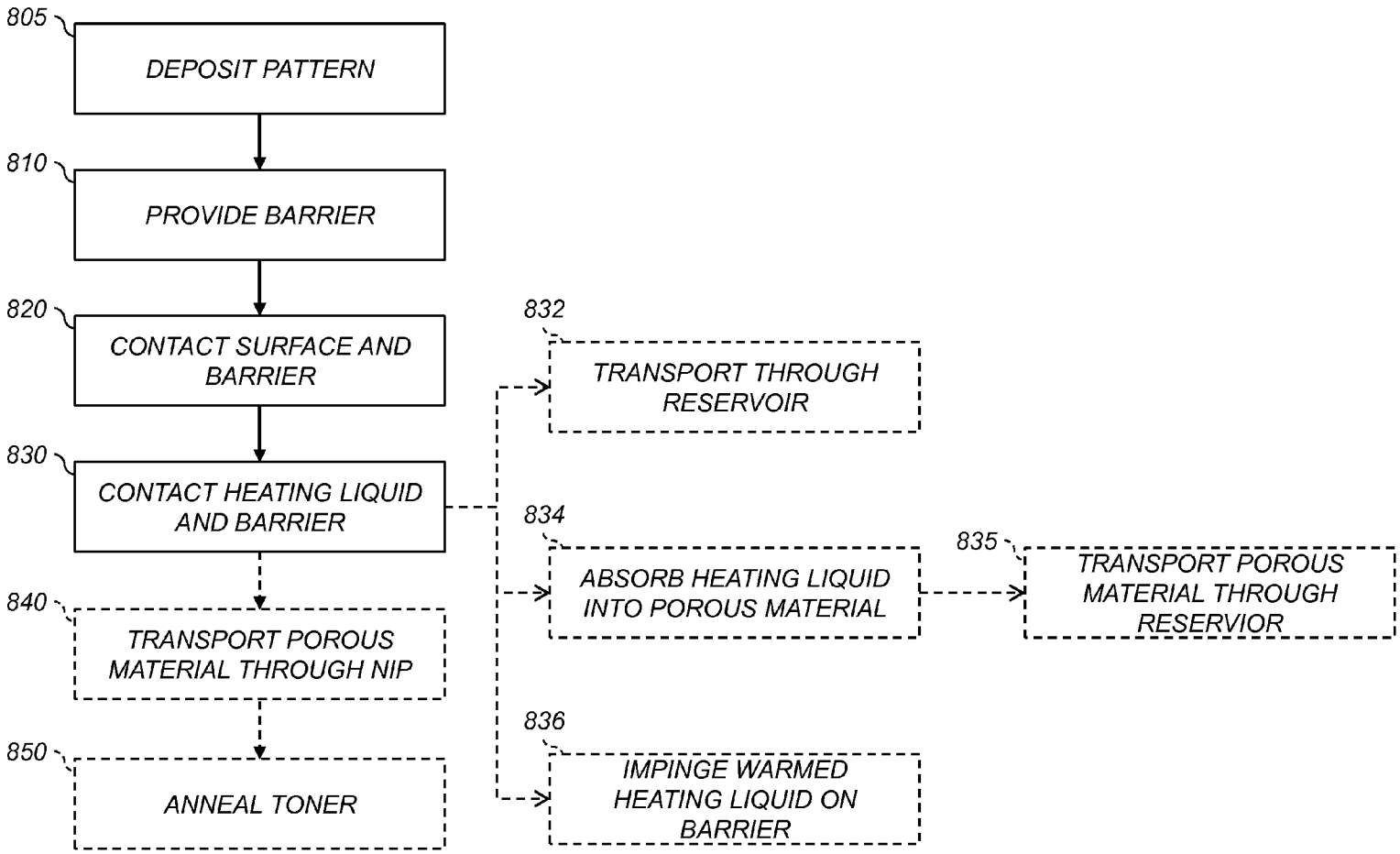
FIG. 8 is a flowchart of ways of fixing toner onto a receiver medium according to various aspects.

FIG. 8 shows methods of fixing toner 420 (FIG. 4) onto a receiver medium 42 (FIG. 4) according to various aspects. The toner 420 (FIG. 4) has a toner glass transition temperature. Processing begins with deposit pattern step 805. An arrow with a triangular arrowhead connects a step to a step that can follow it. An arrow with an open arrowhead connects a step to a substep that step can include.

In deposit pattern step 805, a pattern of toner is deposited onto a surface of the receiver medium. As discussed above, the pattern can be a solid area, an image, text, or another pattern. Deposit pattern step 805 is followed by provide barrier step 810.

In provide barrier step 810, a liquid-blocking barrier is provided. The barrier has a first surface and a second surface that is impermeable to heating liquid 415 (FIG. 4). Provide barrier step 810 is followed by contact surface and barrier step 820.

In contact surface and barrier step 820, a surface of the receiver medium 42 is brought into contact with the first surface of the liquid-blocking barrier. In various aspects, the liquid-blocking barrier is permeable to water vapor (e.g., is made of GORE-TEX), as described above. For example, the receiver medium can include moisture, as most papers do (see FIG. 2). The liquid-blocking barrier can be permeable to the vapor form of that moisture. In various aspects, the liquid-blocking barrier is a membrane belt which moves together with the receiver medium. Contact surface and barrier step 820 is followed by contact heating liquid and barrier step 830.

In contact heating liquid and barrier step 830, the heating liquid 415 is brought into contact with the second surface of the liquid-blocking barrier. The heating liquid 415 is at a temperature greater than the toner glass transition temperature, so heat is transferred through the liquid-blocking barrier from the heating liquid 415 to the toner 420. This raises the temperature of toner 420 to a temperature above the toner glass transition temperature thereof, fixing or assisting in fixing toner 420 onto receiver medium 42. In various aspects, the temperature of the warmed heating liquid is less than a medium degradation temperature above which the receiver medium irreversibly degrades. In various aspects, the temperature of the warmed heating liquid is less than a toner degradation temperature above which the toner irreversibly degrades.

In various aspects, the liquid-blocking barrier forms an outer surface of a reservoir containing the heating liquid 415 such that the heating liquid 415 contacts the second surface of the liquid-blocking barrier. The receiver medium 42 is moved along a transport path which brings the receiver medium 42 into contact with the liquid-blocking barrier forming the outer surface of the reservoir. The liquid-blocking barrier moves together with the receiver medium 42 while they are in contact. The liquid-blocking barrier can be a belt or the circumferential surface of a drum. In an example, the liquid-blocking barrier is the sidewall of a drum, and the receiver medium 42 is run against the drum to heat the receiver medium 42.

In various examples, the liquid-blocking barrier forms an outer surface of a heating belt. The heating belt includes a backing layer arranged with respect to the liquid-blocking barrier to form a sealed liquid cavity extending along the heating belt. For example, the belt can be shaped like an inner tube stretched normal to the plane of the inner tube. The liquid cavity contains the heating liquid 415 such that the heating liquid 415 contacts the second surface of the liquid-blocking barrier. In various aspects, the heating liquid 415 can undergo a phase change, as described above. Solidification can be an exothermic process and the latent heat released can be used to help raise the temperature of toner 420.

In various examples, the overall rate of crystallization on a liquid-to-solid phase change is kept sufficiently high to inhibit the growth of large crystals. The result is that the heating liquid 415 solidifies in the liquid cavity into a powder. The heating belt can thus move even though the heating liquid 415 has solidified, since motion of the heating belt will displace powder grains with respect to each other. In various aspects, this powder is produced by seeded crystallization. The liquid cavity contains a plurality of seed crystals. These seed crystals can be solid particulates of the same material as the heating liquid, and serve as nucleation sites for crystallization, hence solidification. The interior walls of the liquid cavity can also have nucleation sites protruding from them, e.g., a flexible, fuzzy structure.

In other aspects, the heating liquid 415 is very friable when it solidifies (e.g., wax). Motion of the heating belt can thus readily bend or break the solidified heating liquid 415, permitting normal motion of the belt even while the liquid cavity contains solidified heating liquid 415. These aspects, and those described above using powder, can apply to phase changes described throughout this disclosure.

In optional transport through reservoir step 832, which is part of contact heating liquid and barrier step 830, after the receiver medium 42 is brought into contact with the first surface of the liquid-blocking barrier, which thus provides a blocked region of the receiver medium 42, the blocked region is transported along a transport path through a reservoir containing the heating liquid 415. The blocked region is submerged in the warmed heating liquid 415, thereby bringing the second surface of the liquid-blocking barrier into contact with the heating liquid 415. The blocked region is described further below with reference to FIGS. 9 and 10.

In optional impinge warmed heating liquid on barrier step 836, which is part of contact heating liquid and barrier step 830, the second surface of the liquid-blocking barrier is brought into contact with the heating liquid 415 by using a liquid-delivery system to impinge the warmed heating liquid 415 onto the second surface of the liquid-blocking barrier. The liquid-delivery system can include a spray or curtain, as described below.

In various aspects, the heating liquid 415 undergoes a phase change while heat is being transferred from the heating liquid 415 to the toner 420, as described above. The phase change releases heat such that at least a portion of the released heat contributes to raising the temperature of toner 420. In variations of these aspects, the phase change is a liquid-to-solid phase change, or another exothermic phase change that releases heat.

In variations of these aspects, the rotatable liquid-blocking barrier is a liquid-blocking belt which travels along a belt path. At least some of the heating liquid 415 is solid after the phase change. The belt path is arranged so that after the blocked region is transported through the reservoir or heating liquid 415 is impinged onto the surface of the liquid-blocking belt, solidified heating liquid 415 is dislodged from the liquid-blocking belt as the belt undergoes a change in surface orientation. This is as described above with respect to changes in surface orientation of the receiver medium 42; the same applies to the belt. When the belt changes surface orientation, the receiver medium 42 in contact therewith does also.

In optional absorb heating liquid into porous material step 834, which is part of contact heating liquid and barrier step 830, the heating liquid 415 is absorbed into a porous material. The porous material containing the absorbed hearing liquid 415 contacts the second surface of the liquid-blocking barrier. In various aspects, the porous material is permanently affixed to the second surface of the liquid-blocking barrier. For example, the liquid-blocking barrier can be a belt with an open-cell foam affixed (e.g., glued) to the side opposite the side that contacts the receiver medium 42. In various aspects, the porous material forms a porous belt that is brought into contact with the second surface of the liquid-blocking barrier. For example, the liquid-blocking barrier can be a belt, and a separate belt of foam can be brought into contact with the liquid-blocking barrier only in a region in which the receiver medium 42 contacts the liquid-blocking barrier.

In optional transport porous material through reservoir step 835, which is part of optional absorb heating liquid into porous material step 834, the porous material is transported through a reservoir containing the heating liquid 415. The porous material in the reservoir absorbs the warmed heating liquid 415. This permits effectively transporting heat, in the form of warmed heating liquid 415, from a reservoir to a contact region in which the heat is transferred through the liquid-blocking barrier to the receiver medium 42. Various aspects using porous material are discussed below with reference to FIGS. 12-14.

In various aspects, contact heating liquid and barrier step 830 uses optional absorb heating liquid into porous material step 834 and is followed by optional transport porous material through nip step 840. In step 840, the porous material is transported through a nip formed in a roller assembly, thereby squeezing at least some heating liquid 415 out of the porous material. When some or all heating liquid 415 is squeezed out of the porous material, the porous material's ability to transfer heat to toner 420 is reduced. This can be used to control the gloss of fixed toner 420.

In various aspects, a location of the nip is adjustable between a plurality of nip positions to control the amount of heat transferred from heating liquid 415 to toner 420. In at least one of the nip positions, the surface of receiver medium 42 is in contact with the first surface of the liquid-blocking bather and the porous material is in contact with the second surface of the liquid-blocking barrier while the porous material is transported through the nip. That is, the stack of receiver medium 42, liquid-blocking barrier, and porous material is passed through a nip together. In other aspects, that sandwich is entrained around a pressure roller adjacent to the porous material so that heating fluid 415 is squeezed out of the porous material but the pressure on the toner is smaller than if passing through a two-roller nip.

When the nip is adjusted downstream so that heating fluid 415 in the porous material is in contact with the liquid-blocking barrier for a longer period of time, toner 420 has relatively more time to soften and relax. When the nip is adjusted upstream so that heating fluid 415 in the porous material is in contact with the liquid-blocking barrier for a shorter period of time, toner 420 has relatively less time to soften and relax.

In various aspects, step 840 is followed by optional second anneal-toner step 850. In these aspects, contact heating liquid and barrier step 830 is a first annealing step. Contact heating liquid and barrier step 830 includes fixing toner on the surface of the receiver medium. The fixing is accomplished by heat transfer from the heating liquid in the porous material across the liquid-blocking barrier. In various aspects, the liquid-blocking barrier is pressed against the receiver medium to more strongly affix the toner to the receiver medium. The toner is heated above $T_g$. This permits internal stresses in the toner to relax, since the molecules of warm toner can move past and around each other. However, since the toner surface is maintained in contact with a smooth surface of the liquid-blocking barrier, toner molecules cannot protrude from the face of the toner pattern. As a result, the toner pattern after step 830 has a glossy finish.

In second anneal-toner step 850, the fixed toner on the surface of the receiver medium is annealed by applying heat thereto using an annealing heat source. The toner is heated to an annealing temperature above room temperature, and optionally above 40° C. The annealing temperature should generally be below $T_g$ (e.g., by 5° C.). For example, for polyester with $T_g$=55° C., the annealing temperature can be between 40° C. and 50° C. The annealing heat source can be any heat source described herein for adding heat to the heating liquid. The annealing heat source and the transport path of the receiver medium are arranged so that the toner on the receiver medium is softened and has an opportunity to relax.

As a result of the second annealing in second anneal-toner step 850, a surface finish of the toner on the receiver medium is controlled dependent on the location of the nip. Specifically, if the toner has had relatively more time to relax in the first annealing in contact heating liquid and barrier step 830 (the nip is farther downstream), the toner will be more glossy after annealing because it annealed while in contact with the liquid-blocking barrier during the contact heating liquid and barrier step 830. If the toner has had relatively less time to relax in the first annealing during the contact heating liquid and barrier step 830 (the nip is farther upstream), the toner will be less glossy after annealing because more of the internal stress will be released during the second anneal-toner step 850 while the toner surface is not mechanically constrained. This permits toner molecules to bend, twist, and rearrange themselves in three dimensions while the stresses relax during the second anneal-toner step 850. As a result, the toner surface will be rougher and will scatter light more diffusely. Therefore, controlling the nip position controls the amount of time the toner has to relax, and thus controls the post-annealing gloss of the toner Annealing is also discussed below with respect to FIG. 19.

Figure 9:
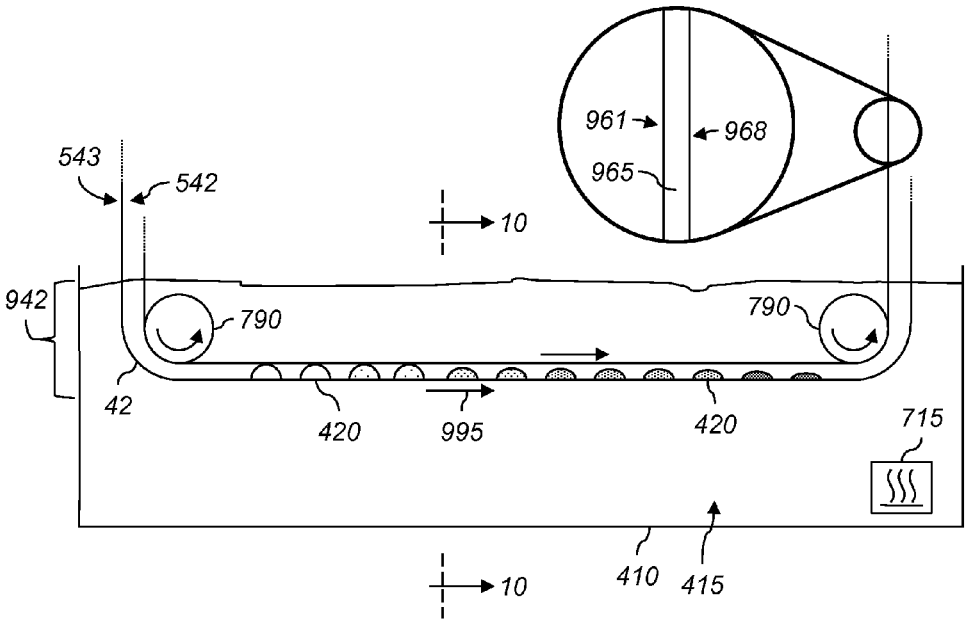
FIGS. 9 and 10 are side and front elevational cross-sections, respectively, of toner fixing systems for fixing toner onto a receiver medium according to various aspects.

FIG. 9 is a side elevational cross-section of an exemplary toner fixing system for fixing toner 420 onto receiver medium 42 having surfaces 542, 543 (discussed above) according to various aspects. Toner 420 has a toner glass transition temperature. Reservoir 410 contains heating liquid 415, as discussed above with respect to FIG. 4. Liquid-heating system 715 warms heating liquid 415 in reservoir 410 to a temperature greater than the toner glass transition temperature, as discussed above with reference to FIG. 7.

Rotatable liquid-blocking barrier 965 has inner surface 961 and outer surface 968. A media-transport system, in this example including rotatable members 790, transports receiver medium 42 along a transport path 995. Along the transport path 995, the receiver medium 42 is entrained around liquid-blocking barrier 965 so that surface 542 of receiver medium 42 is brought into contact with outer surface 968 of liquid-blocking barrier 965. Liquid-blocking barrier 965 can take many forms including a thin membrane, a sheet of metal (relatively more or relatively less flexible), or a polymer sheet or belt. Here and throughout this disclosure, a "liquid-blocking barrier" can be a layer or part of another structure, except as specified.

Liquid-blocking barrier 965 and reservoir 410 are arranged so that entrained portion 942 of receiver medium 42 passes through reservoir 410. Entrained portion 942 is thus submerged in warmed heating liquid 415. This can bring heating liquid 415 into contact with inner surface 961 of the liquid-blocking barrier 965, so heat is transferred through liquid-blocking barrier 965 from warmed heating liquid 415 to toner 420. This can also bring heating liquid 415 into contact with surface 543 of receiver medium 42, thereby transferring heat into receiver medium 42 to toner 420. In either situation, the heat transfer raises the temperature of the toner to a level above the toner glass transition temperature ($T_g$), represented graphically by the increasingly-dense hatching of toner 420 (heating). The size change of graphical representations of toner 420 represents softening that accompanies heating above $T_g$.

In various aspects, rotatable liquid-blocking barrier 965 is a circumferential surface of a drum that rotates around a central axis. In various aspects, rotatable liquid-blocking barrier 965 is a belt that is transported around a belt path.

In various aspects, liquid-blocking barrier 965 is permeable to vaporized moisture that evaporates from receiver medium 42 while receiver medium 42 is submerged in heating liquid 415. In an example, liquid-blocking barrier 965 is formed from GORE-TEX or a similar material that blocks liquid but is permeable to vapor.

In various aspects, warmed heating liquid 415 undergoes a phase change while heat is being transferred from warmed heating liquid 415 to toner 420, as discussed above. The phase change releases heat so that at least a portion of the released heat contributes to raising the temperature of toner 420. The phase change can be a liquid-to-solid phase change, or another exothermic phase change that releases heat.

In various aspects, the temperature of warmed heating liquid 415 is less than a medium degradation temperature above which receiver medium 42 irreversibly degrades, as discussed above. In various aspects, the temperature of warmed heating liquid 415 is less than a toner degradation temperature above which toner 420 irreversibly degrades.

Figure 10:
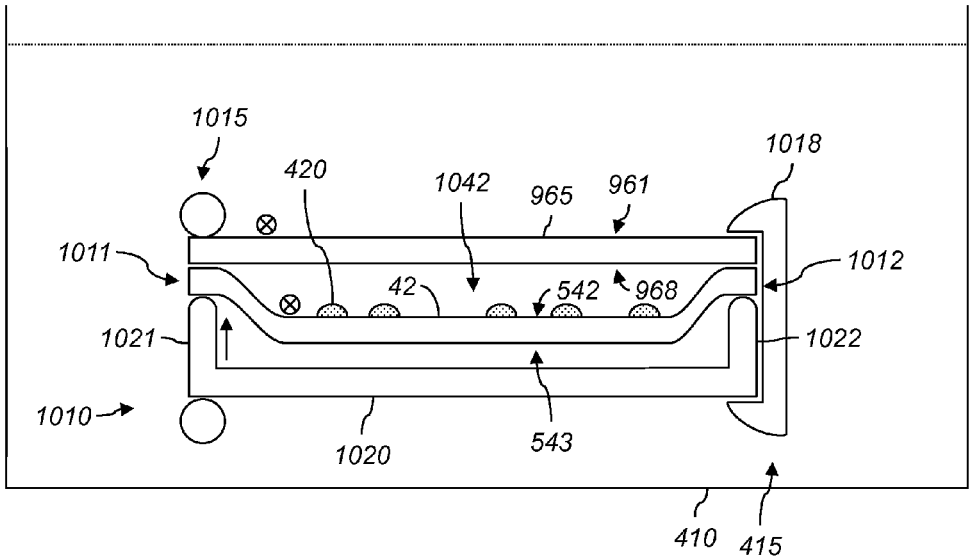

FIG. 10 shows a front elevational section along the line 10-10 in FIG. 9 according to various aspects. Reservoir 410, heating liquid 415 (the top surface of which is represented by a broken line), receiver medium 42, toner 420, surfaces 542 and 543, liquid-blocking barrier 965, inner surface 961 and outer surface 968 are as shown in FIG. 9. The transport path 995 (FIG. 9) of receiver medium 42 extends into the plane of the page, as indicated.

In various aspects, sealing mechanism 1010 seals edges 1011, 1012 of receiver medium 42 to liquid-blocking barrier 965. In variations of these aspects, sealing mechanism 1010 includes backing member 1020 that presses receiver medium 42 against outer surface 968 of the liquid-blocking barrier 965. Backing member 1020 can include ribs 1021, 1022 that exert pressure on edges 1011, 1012 of receiver medium 42. In various aspects, backing member 1020 is a ribbed belt including one or more ribs at appropriate cross-track positions that press against receiver medium 42. This pressure presses corresponding portions of receiver medium 42 against liquid-blocking barrier 965, enclosing lumen 1042 in which toner 420 is kept from contact with heating liquid 415. Backing member 1020 can be pressed against receiver medium 42 by a piston or shoe, or by the position of rollers around which it is entrained.

In various aspects, backing member 1020, receiver medium 42, and liquid-blocking barrier 965 are pressed together and pulled together through a channel that exerts pressure on edges 1011, 1012 to seal lumen 1042, thereby substantially preventing the heating liquid 415 from directly contacting surface 542 of the receiver medium 42. Specifically, in various aspects, sealing mechanism 1010 includes edge-clamping mechanism 1015 (represented graphically as two circular cross-section portions of a band or tube; for clarity, only shown on one edge) that clamps edges 1011, 1012 of receiver medium 42 to liquid-blocking barrier 965. Edge-clamping mechanism 1015 can also clamp an edge of backing member 1020 (as shown), or not. In various aspects, sealing mechanism 1010 includes one or more O-rings (not shown) arranged between the edges of the receiver medium 42 and the liquid-blocking barrier 965. In various aspects, sealing mechanism 1010 includes edge seals 1018 that cover the edges of the receiver medium. For clarity, these are shown only on one edge, but they can be provided on both edges 1011, 1012 of medium 42. Edge seal 1018 can be a ribbed belt rotating around rollers on vertical axes. Edge seal 1018 can also cover an edge of backing member 1020 (as shown), or not.

In various aspects, heating liquid 415 is miscible with toner 420, or dissolves or plasticizes toner 420. Liquid-blocking barrier 965 and receiver medium 42 form lumen 1042, as described above, so that heating liquid 415 is substantially unable to mix with, dissolve, or plasticize toner 420.

FIG. 11 is a side-elevational cross-section of an exemplary toner fixing system for fixing toner 420 onto receiver medium 42 having surfaces 542 and 543. Toner 420 has a toner glass transition temperature. Rotatable heating member 1160 is provided, which in this example is a partially-hollow drum arranged to rotate around axis 1116. Rotatable heating member 1160 includes liquid-blocking barrier 1165 with inner surface 1161 and outer surface 1168. Backing layer 1175 is affixed to liquid-blocking barrier 1165 to define a liquid cavity 1115 between the liquid-blocking barrier 1165 and the backing layer 1175. Liquid cavity 1115 does not include axis 1116. That is, axis 1116 passes through a region of space not included in liquid cavity 1115. Liquid cavity 1115 is at least partially filled with heating liquid 415 sealed between liquid-blocking barrier 1165 and backing layer 1175 so that heating liquid 415 is in contact with inner surface 1161 of liquid-blocking barrier 1165.

Liquid-heating system 715, represented graphically here, warms heating liquid 415 in liquid cavity 1115 to a temperature greater than the toner glass transition temperature, as represented graphically by the dark hatching. Liquid-heating system 715 can include a resistive or other type of heater, as described above. Heating liquid 415 can completely fill liquid cavity 1115 or not. In various aspects, the rotation of rotatable heating member 1160, or vanes or other structures inside liquid cavity 1115, mixes heating liquid 415 in liquid cavity 1115 to provide a substantially uniform temperature along the width of rotatable heating member 1160 (in and out of the page, in this figure). Various aspects advantageously use the heat-transport capability of heating liquid 415 to apply heat to toner 420 without requiring a large amount of heating liquid 415, and therefore without requiring as much heat or time to heat as a larger amount of heating liquid 415. The use of liquid-blocking barrier 1165 can reduce degradation of an image formed from toner 420.

A media-transport system, e.g., including rotatable members 790 (e.g., belts or drums, or a belt entrained around multiple drums), transports receiver medium 42 along a transport path 1195 in which receiver medium 42 contacts or is entrained around rotatable heating member 1160 so that surface 542 of receiver medium 42 is brought into contact with outer surface 1168 of liquid-blocking barrier 1165. Heat is transferred through liquid-blocking barrier 1165 from warmed heating liquid 415 to toner 420, thereby raising a temperature of toner 420 to a level above the toner glass transition temperature. Liquid-blocking barrier 1165 can be a thin membrane, a metal layer, or other layer types described herein.

In various aspects, rotatable heating member 1160 is a belt that is transported around a belt path. In an example, rotatable heating member 1160 is entrained around two rollers and the belt path passes around those rollers and along an approximately straight line between them. Axis 1116 passes through an interior of the belt path, e.g., between the two rollers. In various aspects, a backing member 1180 presses receiver medium 42 against the outer surface 1168 of the liquid-blocking barrier 1165 of rotatable heating member 1160. Backing member 1180 can be a shoe, belt, drum, wedge, piston, or other device for pressing.

In various aspects, liquid-heating system 715 warms heating liquid 415 by conduction or radiation. For example, liquid-heating system 715 can include a resistor or other electrical heating element arranged in liquid cavity 1115, either rotating with rotatable heating member 1160 or not. In various aspects, liquid-heating system 715 warms heating liquid 415 external to rotatable heating member 1160. Liquid-heating system 715 then circulates warmed heating liquid 415 through liquid cavity 1115 in rotatable heating member 1160. In an example, rotatable heating member 1160 is a drum that is toroidal in cross-section, mounted at one end of axis 1116. The other end has a plate that can remain stationary while the drum rotates. That plate is sealed around the edges and forms part of liquid-blocking barrier 1165. The plate has an inlet and an outlet, and the outlet is below the inlet. Liquid-heating system 715 pumps warmed heating liquid 415 into the inlet, and pumps heating liquid 415 that has transferred some heat to toner 420 out the outlet.

In various aspects, the temperature of warmed heating liquid 415 is less than a medium degradation temperature above which the medium 42 irreversibly degrades. In various aspects, the temperature of warmed heating liquid 415 is less than a toner degradation temperature above which toner 420 irreversibly degrades.

FIG. 12 is an elevational cross-section of an exemplary toner fixing system for fixing toner 420 onto receiver medium 42 having surfaces 542 and 543 according to various aspects. Toner 420 has a toner glass transition temperature. Reservoir 410 contains heating liquid 415. Liquid-heating system 715 warms heating liquid 415 in reservoir 410 to a temperature greater than the toner glass transition temperature.

Rotatable liquid-blocking barrier 1165 has inner surface 1161 and outer surface 1168, as discussed above. A media-transport system (e.g., including rotatable members 790 such as belts or drums, or a belt entrained around multiple drums) transports receiver medium 42 along a transport path 1295 in which receiver medium 42 contacts, or is entrained around, liquid-blocking barrier 1165 in contact zone 1270. Surface 542 of receiver medium 42 is thus brought into contact with outer surface 1168 of liquid-blocking barrier 1165. Backing members (e.g., backing member 1180 shown in FIG. 11) can optionally be used to press the receiver medium 42 against the liquid-blocking barrier 1165.

Porous material 1280, represented graphically as spheres adjacent to inner surface 1161, absorbs heating liquid 415 from reservoir 410 so that the heating liquid 415 in porous material 1280 is brought into contact with inner surface 1161 of liquid-blocking barrier 1165 for at least part of contact zone 1270, and optionally elsewhere. This is represented graphically by the darkening hatching (darker corresponds to hotter) as rotatable liquid-blocking barrier 1265 rotates clockwise (in this example), carrying portions of porous material 1280 through heating liquid 415. In this manner, porous material 1280 and the heating liquid 415 absorbed or otherwise contained therein are then carried towards receiver medium 42. In contact zone 1270, heat is transferred through liquid-blocking barrier 1165 from the absorbed warmed heating liquid 415 to toner 420. This is represented graphically by the dark hatching on toner 420 leaving contact zone 1270, fading gradually as toner 420 cools. This can raise the temperature of toner 420 to a level above the toner glass transition temperature. Softening of toner 420 is represented graphically by the reduction in size of drops of toner 420 left to right through the contact zone 1270 and continuing to the right.

In the example shown, liquid-blocking barrier 1165 is a rotatable cylinder or drum at least partly open at the ends, or including pores or voids through which heating liquid 415 can pass. Rotatable heating member 1160 rotates around a central axis (not shown). Porous material 1280 is permanently affixed (e.g., glued) to inner surface 1161 of liquid-blocking barrier 1165. A lower portion of the drum (liquid-blocking barrier 1265) is submerged in heating liquid 415 in reservoir 410. The drum (liquid-blocking barrier 1265) rotates to transport heating liquid 415 absorbed in porous material 1280 from reservoir 410 to receiver medium 42, where it surrenders heat to toner 420 in contact zone 1270, which corresponds to an upper portion of the drum (liquid-blocking barrier 1265). The absorbed heating liquid 415 itself remains in porous material 1280. The cooled heating liquid 415 in porous material 1280 then travels back to reservoir 410 to be reheated or replaced by heated heating liquid 415.

In various aspects, dryer 1285 (e.g., shown as a roller nip), squeezes or wrings porous material 1280, or otherwise removes cooled heating liquid 415 from porous material 1280, after the heat is transferred to toner 420. This removal permits porous material 1280 to readily absorb fresh, hot heating liquid 415 in reservoir 410. Heating liquid 415 removed from porous material 1280 can be returned to reservoir 410 for re-heating. Returning can be accomplished by positioning dryer 1285 to drip the removed heating liquid 415 directly into reservoir 410, as shown, or by transporting removed heating liquid 415 through a liquid transport (e.g., a pump).

In various aspects, rotatable liquid-blocking barrier 1165 is a circumferential surface of a drum that rotates around a central axis (not shown). Reservoir 410 is contained within the drum. This permits using less liquid, since the liquid can fill only part of the drum (liquid-blocking barrier 1265), and reduces heat loss compared to a reservoir in which a significant surface area of heating liquid 415 is exposed to air or another atmosphere or environment cooler than heating liquid 415.

In various aspects, the warmed heating liquid 415 undergoes a phase change while heat is being transferred from the warmed heating liquid 415 to the toner 420. As described herein, the phase change releases heat such that at least a portion of the released heat contributes to fixing the toner 420. The phase change can be a liquid-to-solid phase change, or another exothermic phase change that releases heat. Various examples described herein can be used. Heating liquid 415 in the pores of porous material 1280 can solidify into grains of a powder, which then melt into a liquid in reservoir 410.

In various aspects, the temperature of warmed heating liquid 415 is less than a medium degradation temperature above which the medium 42 irreversibly degrades. In various aspects, the temperature of warmed heating liquid 415 is less than a toner degradation temperature above which toner 420 irreversibly degrades.

Figure 13:
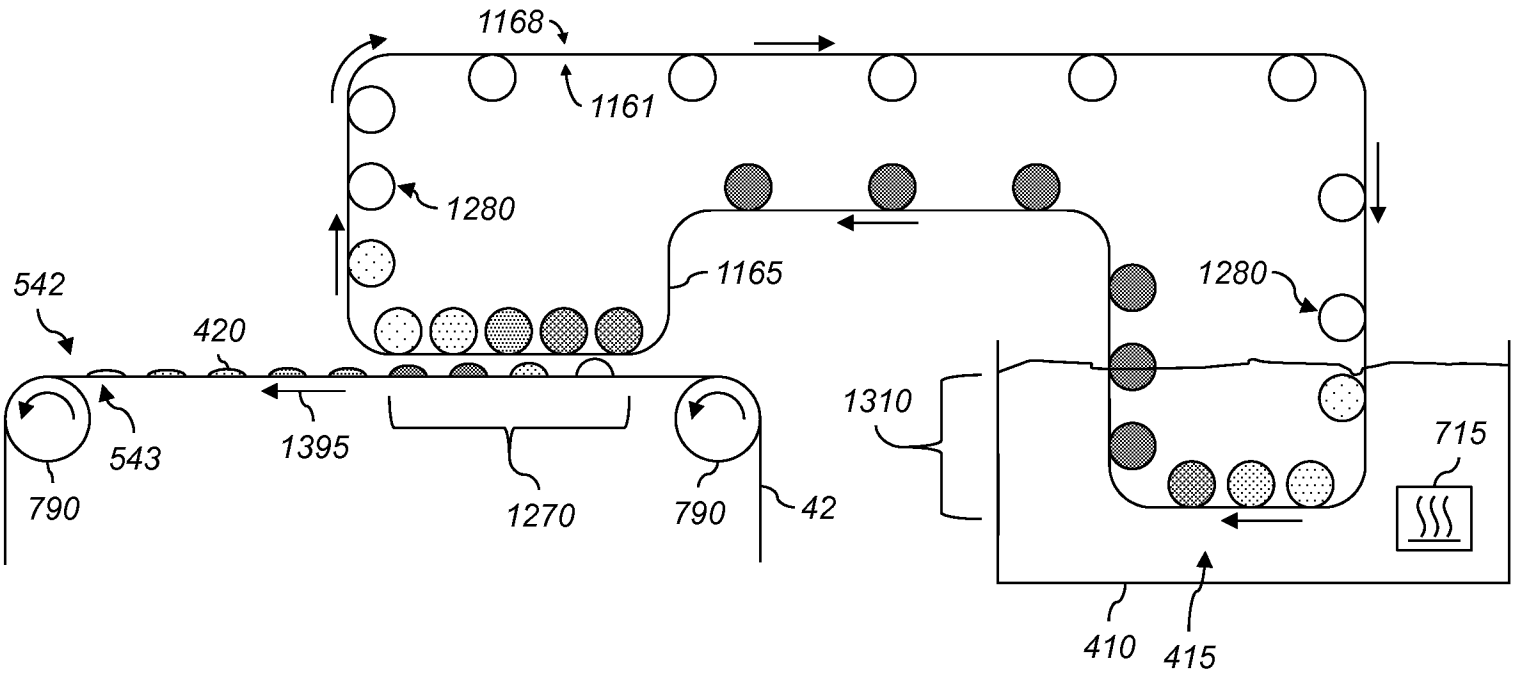

FIG. 13 is an elevational cross-section of an exemplary toner fixing system for fixing toner 420 onto receiver medium 42 according to various aspects. Toner 420, receiver medium 42, surfaces 542 and 543, reservoir 410, heating liquid 415, liquid-heating system 715, liquid-blocking barrier 1165, inner surface 1161, outer surface 1168, rotatable members 790 of a media-transport system, and contact zone 1270 are as shown above. In this example, rotatable liquid-blocking barrier 1165 is a belt that is transported around a belt path. Porous material 1280 is as described above. For clarity, not all porous material is expressly shown, and the spacing of the shown porous material 1280 is not limiting. Also for clarity, the rotatable members around which rotatable liquid-blocking barrier 1165 is entrained are not shown. In an example, rotatable liquid-blocking barrier 1165 is entrained around several roller pairs. Each roller pair includes two rollers on respective axially-aligned shafts, or on a single shaft. One roller supports a left edge of the belt and one that supports a right edge of the belt. Porous material 1280 passes laterally between the rollers of each pair without being substantially compressed.

A media-transport system, (e.g., including rotatable members 790 such as belts or drums, or a belt entrained around multiple drums), transports receiver medium 42 along a transport path 1395 in which receiver medium 42 contacts, or is entrained around, rotatable liquid-blocking barrier 1165 in contact zone 1270.

In various aspects, the belt (rotatable liquid-blocking barrier 1165) is submerged in heating liquid 415 in reservoir 410 for path portion 1310 of the belt path. This permits the porous material 1280 to absorb or otherwise capture heating liquid 415. The rotatable liquid-blocking barrier 1165 moves around the belt path to transport absorbed heating liquid 415 to contact zone 1270. This advantageously permits using a wide variety of printer geometries, since the transport path 1395 of receiver medium 42 can be positioned many different places with respect to reservoir 410.

Figure 19:
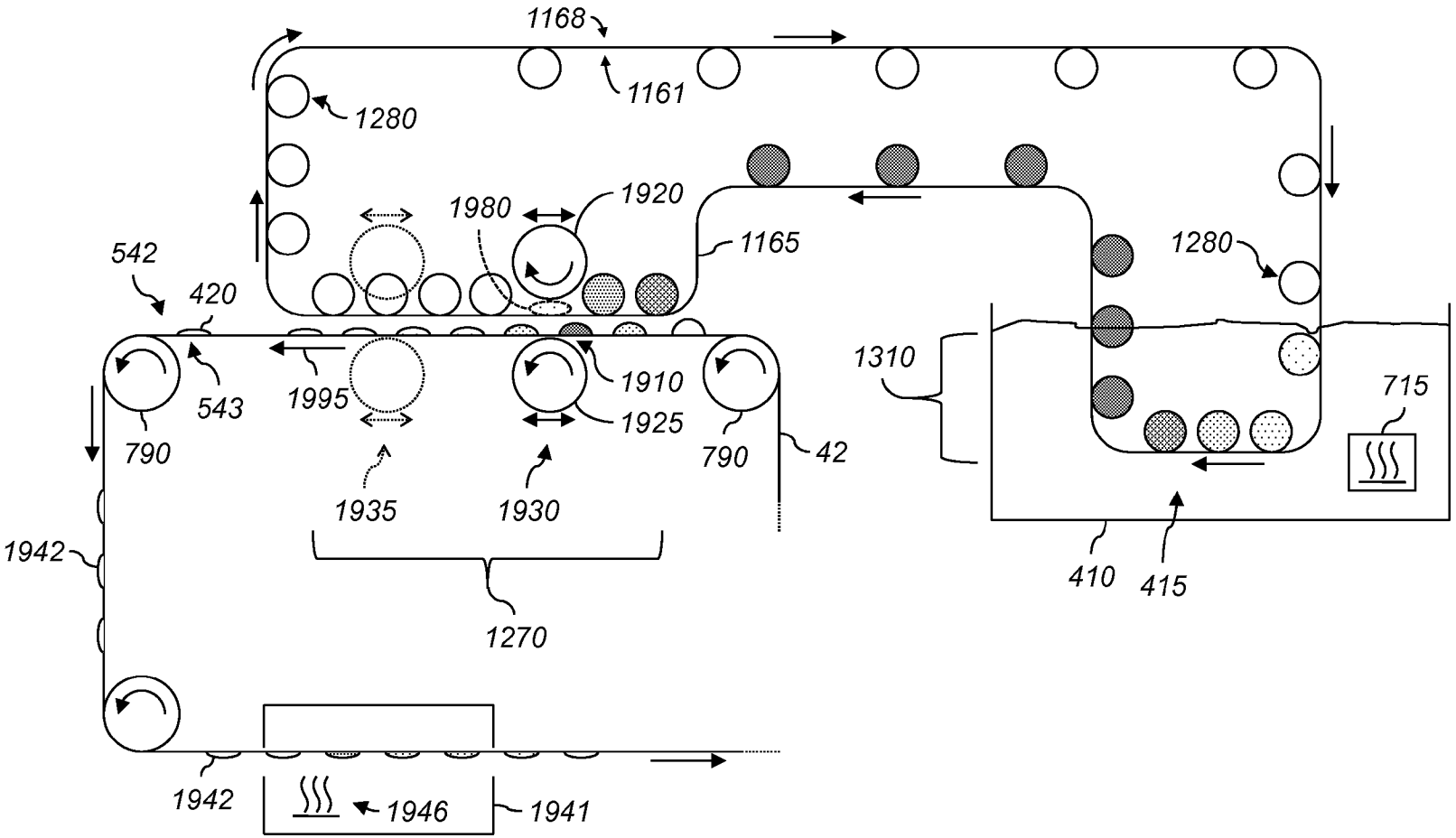
FIGS. 19-21 are elevational cross-sections of toner fixing systems for fixing toner onto a receiver medium according to various aspects.

FIG. 19 is an elevational cross-section of an exemplary toner fixing system for fixing toner 420 onto receiver medium 42 according to various aspects. Toner 420, receiver medium 42, surfaces 542 and 543, reservoir 410, heating liquid 415, liquid-heating system 715, path portion 1310, liquid-blocking barrier 1165, inner surface 1161, outer surface 1168, rotatable members 790 of a media-transport system, contact zone 1270, rotatable liquid-blocking barrier 1165, porous material 1280, and rotatable members 790 are as shown in FIG. 13. Receiver 42 is transported in transport path 1995 in which receiver medium 42 contacts, or is entrained around, rotatable liquid-blocking barrier 1165 in contact zone 1270.

Porous material 1280 is transported through nip 1910 between rotatable members 1920 and 1925, which can be belts or drums. In nip 1910, porous material 1280 is compressed, represented graphically by squeezed porous material 1980 (shown dashed to differentiate it visually). This squeezes at least some of the heating liquid 415 out of porous material 1280. As a result, the heat transfer rate from porous material 1280 to toner 420 is much lower after the nip than before the nip.

In various aspects, a location of nip 1910 is adjustable between a plurality of nip positions 1930, 1935. In this example, nip position 1930 is farther upstream, and nip position 1935 is farther downstream. The location of nip 1910 is controlled by moving rotatable members 1920, 1925. Controlling the location of nip 1910 controls the amount of heat transferred from heating liquid 415 in porous material 1280 to toner 420. With nip 1910 in nip position 1935, more heat is transferred to toner 420 than when nip 1910 is in nip position 1930. In least one of the nip positions 1930, 1935, surface 542 of receiver medium 42 is in contact with surface 1161 of liquid-blocking barrier 1165 and porous material 1280 is in contact with surface 1168 of liquid-blocking barrier 1165 while porous material 1280 is transported through nip 1910.

In various aspects, when heating liquid 415 is brought into contact with surface 1168 of liquid-blocking barrier 1165, the transfer of heat to toner 420 through liquid-blocking barrier 1165 fixes toner on surface 542 of receiver medium 42. After fixing (downstream of contact zone 1270), annealing device 1941 anneals fixed toner 1942 on surface 542 of receiver medium 42. Annealing device 1941 includes annealing heat source 1946 downstream of liquid-blocking barrier 1165 that applies heat to toner 1942. Therefore (as discussed above with reference to step 850, FIG. 8), a surface finish of toner 1942 is controlled dependent on the location of nip 1910. Annealing device 1941 can also include a member (not shown), such as a belt, drum, or plate, that presses on the surface of toner 1942 while toner 1942 is warmed Annealing is discussed above with reference to FIG. 8. Annealing heat source 1946 can warm fixed toner 1942 to a temperature below $T_g$. Specifically, annealing heat source 1946 is downstream of contact zone 1270 and is adapted to raise a temperature of fixed toner 1942 to a level below the toner glass transition temperature.

Figure 14:
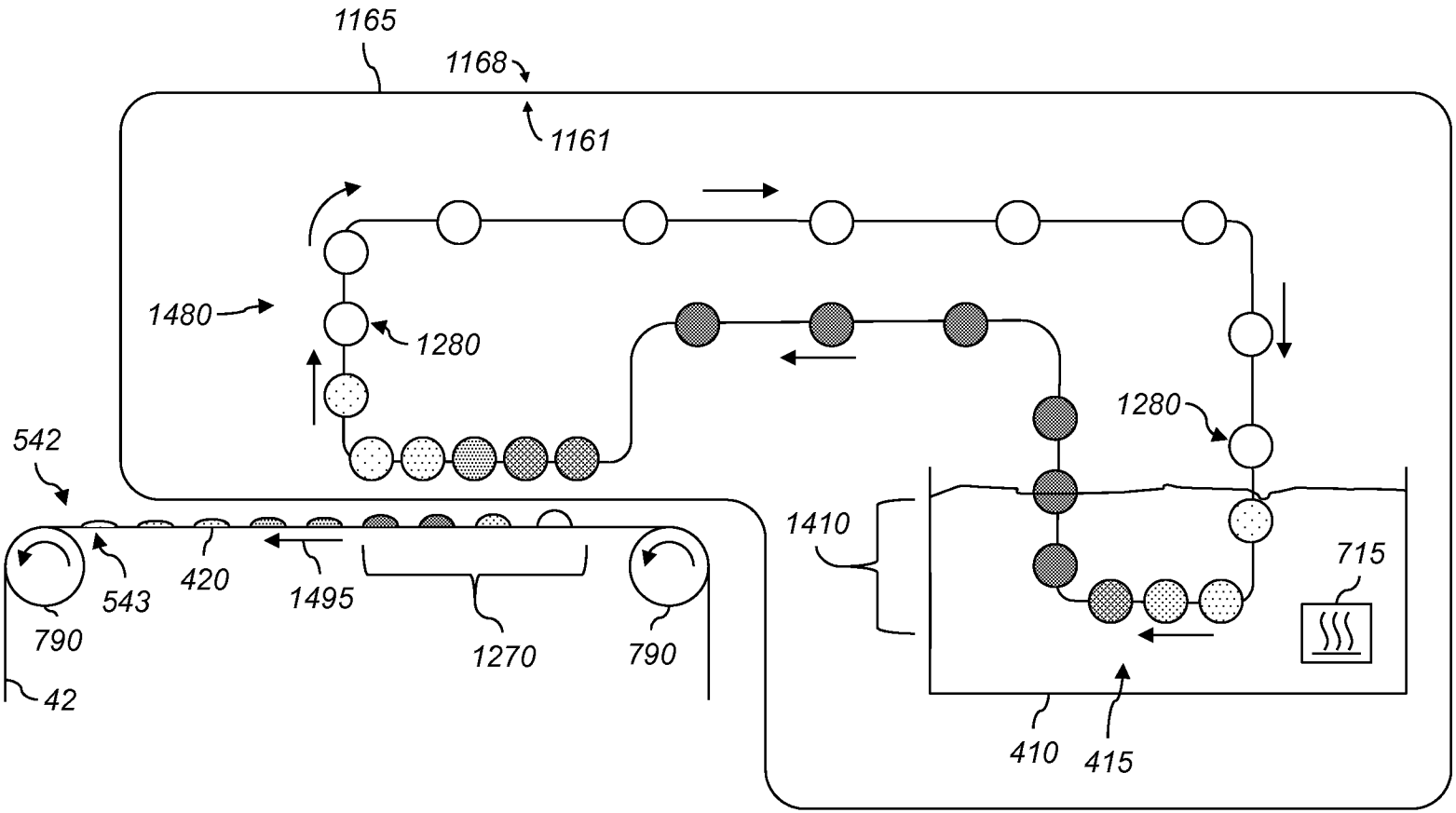

FIG. 14 is an elevational cross-section of an exemplary toner fixing system for fixing toner 420 onto receiver medium 42 according to various aspects. Toner 420, receiver medium 42, surfaces 542 and 543, reservoir 410, heating liquid 415, liquid-heating system 715, liquid-blocking barrier 1165, inner surface 1161, outer surface 1168, rotatable members 790 of a media-transport system, transport path 1495 and contact zone 1270 are as shown above. Rotatable liquid-blocking barrier 1165 is a belt that is transported around a belt path. For clarity, the rotatable members around which rotatable liquid-blocking barrier 1165 is entrained are not shown. In an example, rotatable liquid-blocking barrier 1165 is entrained around roller pairs, as described above Porous material 1280 forms porous belt 1480 that is transported around a porous belt path. Porous belt 1480 is brought into contact with inner surface 1161 of liquid-blocking barrier 1165 for a portion of the porous belt path corresponding to at least a portion of contact zone 1270. For clarity, porous belt 1480, liquid-blocking barrier 1165, and receiver 42 are shown spaced apart in contact zone 1270; this is to permit visually differentiating the various components and is not limiting. In various aspects, porous belt 1480, liquid-blocking barrier 1165, and toner 420 on receiver 42 are in contact with each other while receiver 42 travels through contact zone 1270. In various aspects, porous belt 1480 is transported through reservoir 410 containing heating liquid 415 during path portion 1410 of the porous belt path. In the path portion 1410, porous material 1280 absorbs warmed heating liquid 415.

Various aspects in which porous belt 1480 and rotatable liquid-blocking barrier 1165 are only in contact in the first portion of the porous belt bath can advantageously reduce heat loss due to conduction into rotatable liquid-blocking barrier 1165.

Figure 15:
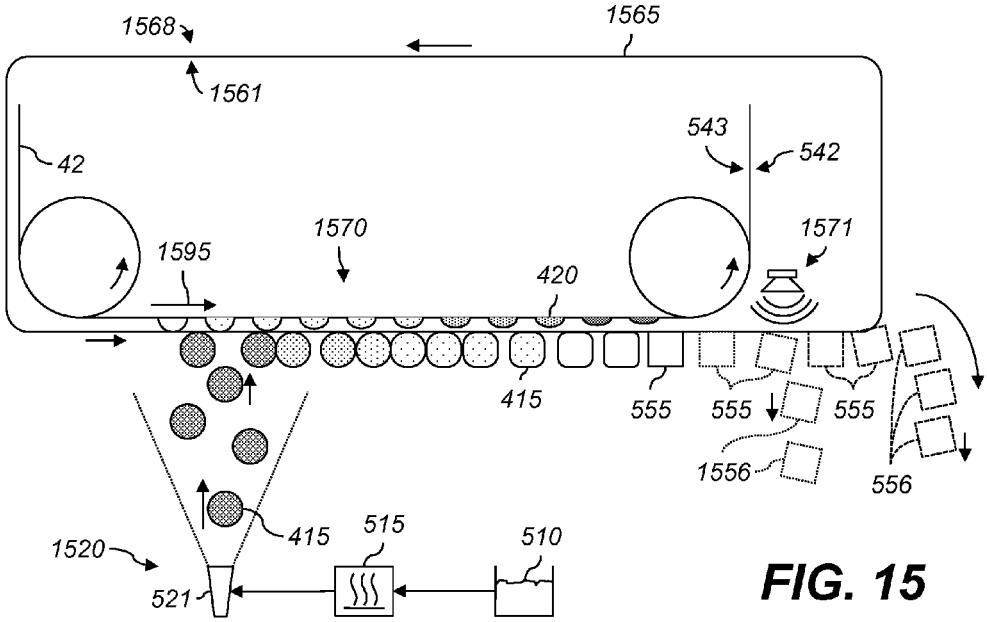
Figure 16:
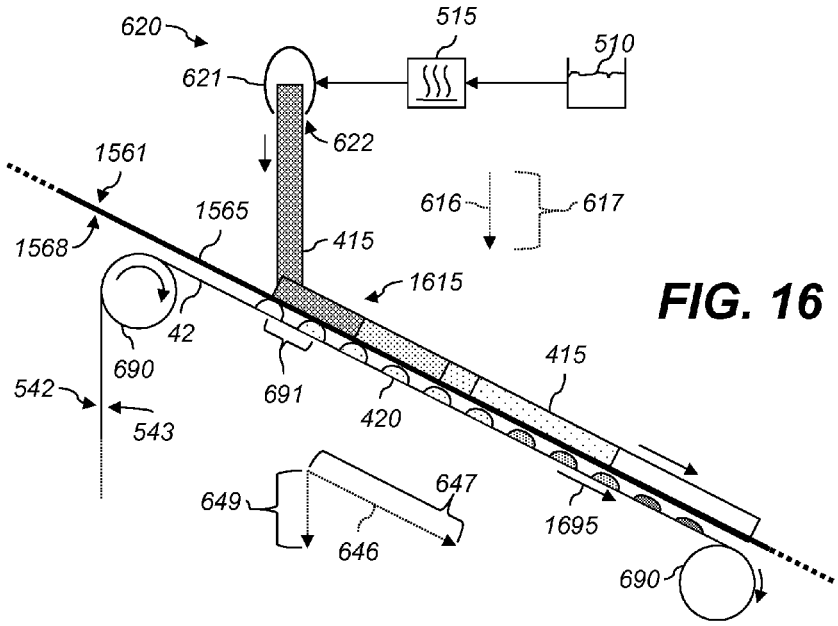
Figure 17:
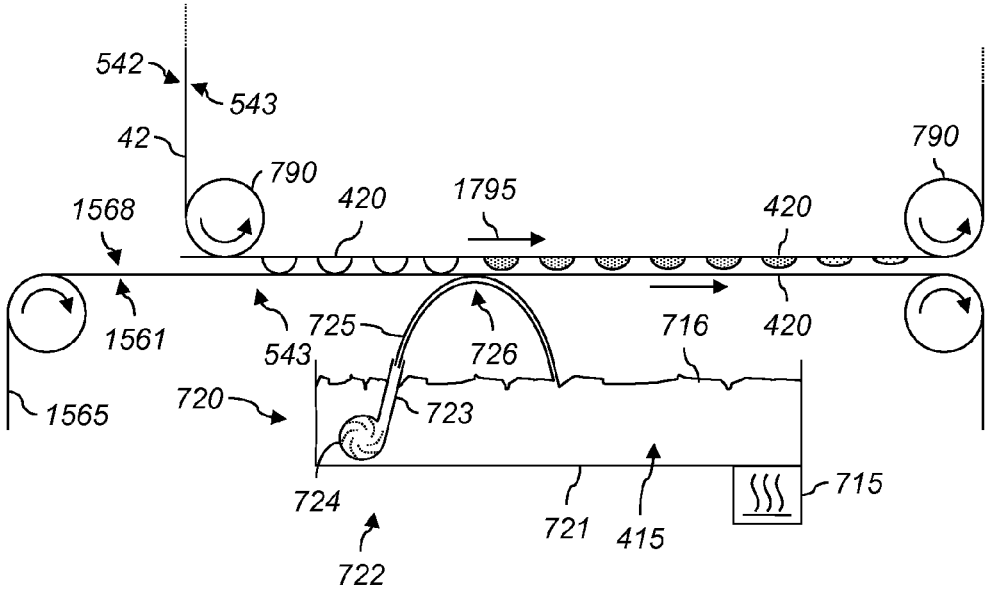

FIGS. 15-17 are elevational cross-sections of exemplary toner fixing systems for fixing toner 420 onto receiver medium 42 having surfaces 542 and 543, the toner 420 having a toner glass transition temperature. In various aspects, the receiver medium 42 includes a printed pattern of toner 420. In various aspects, the temperature of warmed heating liquid 415 is less than a medium degradation temperature above which the medium 42 irreversibly degrades. In various aspects, the temperature of warmed heating liquid 415 is less than a toner degradation temperature above which toner 420 irreversibly degrades.

Referring to FIG. 15, liquid-supply system 510, liquid-heating system 515, and spraying system 521 are as shown in FIG. 5. Rotatable liquid-blocking barrier 1565 has inner surface 1561 and outer surface 1568. For clarity, the rollers, belts, or other members moving liquid-blocking barrier 1565 are not shown (e.g., four drums at the four corners shown). The media-transport system (e.g., rollers moving receiver medium 42) transports receiver medium 42 along a transport path 1595 in which surface 542 of receiver medium 42 is brought into contact with outer surface 1568 of liquid-blocking barrier 1565 in contact zone 1570. Liquid-delivery system 1520 impinges warmed heating liquid 415 onto inner surface 1561 of liquid-blocking barrier 1565 so that heat is transferred through liquid-blocking barrier 1565 from heating liquid 415 to toner 420, thereby raising a temperature of toner 420 to a level above the toner glass transition temperature. In the example shown, liquid-delivery system 1520 includes spraying system 521 for spraying warmed heating liquid 415 onto inner surface 1561 of liquid-blocking barrier 1565, as described above with reference to FIG. 5. Heat is represented by hatching, as described above.

In various examples, warmed heating liquid 415 undergoes a phase change while heat is being transferred from warmed heating liquid 415 to toner 420. The phase change releases heat such that at least a portion of the released heat contributes to fixing toner 420. This is represented graphically by the transition of drops of heating liquid 415, represented as circles, to solidified heating liquid 555, represented as squares. The phase change can be a liquid-to-solid phase change or another exothermic phase change that releases heat.

In various aspects, at least some of the heating liquid is solid after the phase change (solidified heating liquid 555). Rotatable liquid-blocking barrier 1565 is a liquid-blocking belt that travels along a belt path. The belt path is arranged so that solidified heating liquid 555 is dislodged from the liquid-blocking barrier 1565 as it undergoes a change in surface orientation, as described above. This is represented graphically as detached solidified heating liquid 556.

In various aspects, liquid-blocking barrier 1565 is agitated to dislodge solidified heating liquid 555. This is represented graphically by detached solidified heating liquid 1556. Agitation can be performed by agitator 1571 (represented graphically using a speaker symbol). For example, the agitator 1571 can be an oscillatory mechanical transducer, such as an ultrasonic transducer or a motor driving an off-balance counterweight.

Referring to FIG. 16, liquid-supply system 510, liquid-heating system 515, liquid-delivery system 620, curtain-coating system 621, slit 622, receiver medium 42, toner 420, heating liquid 415, media-transport system including rotatable transport members 690, coating region 691, liquid-curtain speed 617, liquid-curtain direction 616, medium-transport speed 647, medium-transport direction 646, and speed component 649 are as shown in FIG. 6. Warmed heating liquid 415 flows through slit 622, thereby forming liquid curtain 1615 that impinges on inner surface 1561 of liquid-blocking barrier 1565. Outer surface 1568 of liquid-blocking barrier 1565 is in contact with receiver medium 42, which is being moved along transport path 1695. Heat is transferred from the warmed heating liquid 415 through the liquid-blocking barrier 1565 to toner 420, thereby raising a temperature of toner 420 to a level above the toner glass transition temperature.

In various aspects, the warmed heating liquid undergoes a phase change, as described above. In various aspects, speed component 649 of the transported receiver medium 42 in liquid-curtain direction 616 is within ±20% of liquid-curtain speed 617 at a point in coating region 691, as described above. In various aspects, speed component 649 is less than speed component 617, as described above.

Referring to FIG. 17, receiver medium 42, surfaces 542 and 543, toner 420, media-transport system including rotatable members 790, liquid-heating system 715, liquid-delivery system 720, tank 721, wave-forming system 722, nozzle 723, pump 724, stationary wave 725, peak 726, top surface 716, and heating liquid 415 are as shown in FIG. 7. Rotatable liquid-blocking barrier 1565 has inner surface 1561 and outer surface 1568. Peak(s) 726 of stationary wave 725 impinge on inner surface 1561 of liquid-blocking barrier 1565. Outer surface 1568 of liquid-blocking barrier 1565 is in contact with receiver medium 42, which is being moved along transport path 1795. Heat is transferred from the warmed heating liquid 415 through the liquid-blocking barrier 1565 to toner 420, thereby raising a temperature of toner 420 to a level above the toner glass transition temperature.

Figure 18:
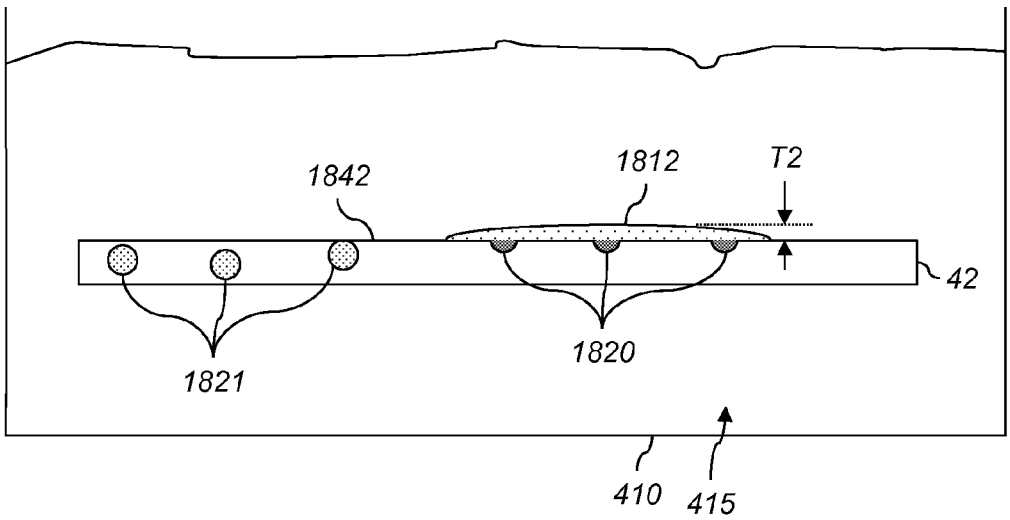
FIG. 18 is a cross-section showing an example of the Leidenfrost effect.

FIG. 18 is a cross-section showing an example of the Leidenfrost effect. Receiver medium 42 has moisture 1821 (shown hatched) therein or thereon, and is submerged (in this example) in heating liquid 415 in reservoir 410. Drops 1820 of moisture are evaporating due to heat transfer from heating liquid 415. This evaporation forms vapor layer 1812. Vapor layer 1812 pushes heating liquid 415 away from surface 1842 of receiver medium 42. Heat conductance across vapor layer 1812 varies inversely to its thickness T2. Therefore, in various aspects, the pressure of heating liquid 415 near vapor layer 1812 is increased to compress the vapor, reducing T2 and increasing the thermal conductance across vapor layer 1812.

Figure 20:
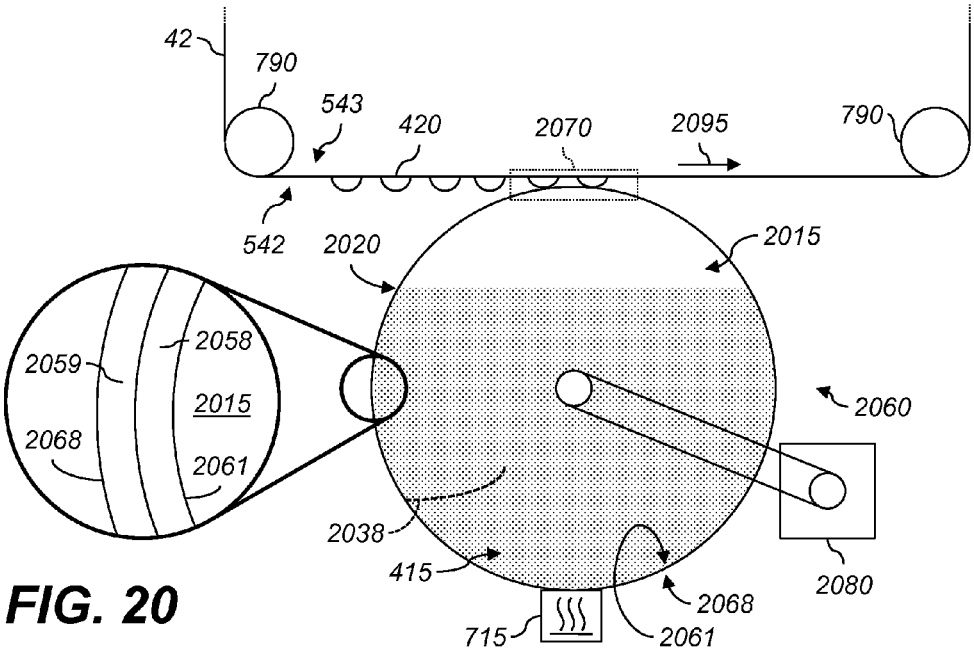

FIG. 20 is a side-elevation cross-section showing toner fixing systems for fixing toner 420 onto receiver medium 42 having surfaces 542 and 543 according to various aspects. Toner 420 has a toner glass transition temperature.

Figure 21:
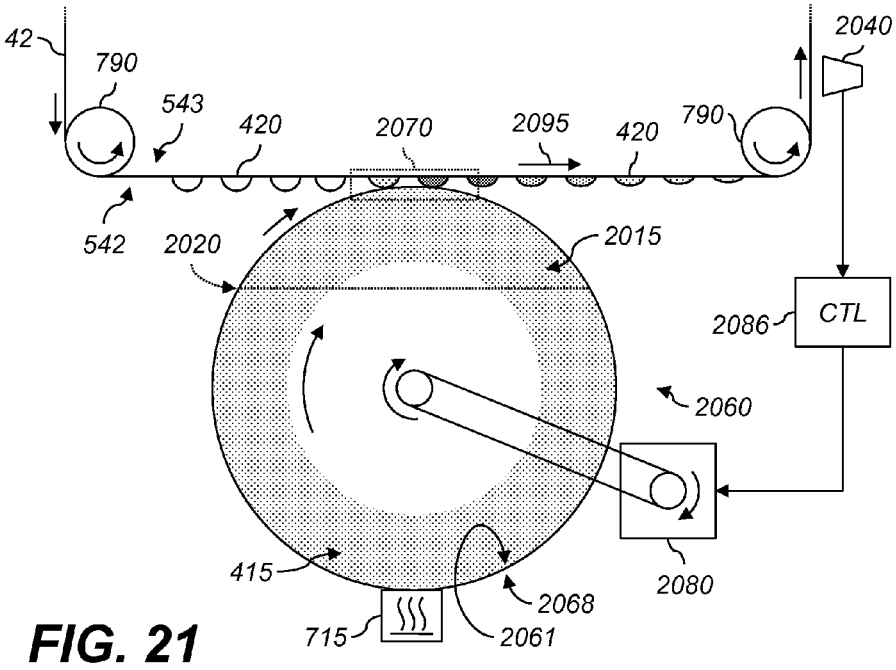

Rotatable fixing drum 2060 is shown stationary in FIG. 20 and rotating in FIG. 21. Fixing drum 2060 has inner surface 2061 and outer surface 2068. Inner surface 2061 encloses volume 2015 partially filled by heating liquid 415 in contact with inner surface 2061. Since volume 2015 is only partially filled, gravity pulls heating liquid 415 down in volume 2015. When fixing drum 2060 is not rotating, the resulting level of heating liquid 415 is stationary-drum liquid level 2020. Liquid-heating system 715 warms heating liquid 415 in volume 2015 to a temperature greater than the toner glass transition temperature.

Drive 2080 selectively rotates fixing drum 2060 with a circumferential speed. The circumferential speed is sufficient to draw the heating liquid to substantially cover inner surface 2061 by centrifugal force. This is discussed below with reference to FIG. 21. Drive 2080 can rotate fixing drum 2060 by direct (shaft) drive, belt drive (as shown), chain drive, or another device for inducing rotary motion of fixing drum 2060.

A media transport system, including rotatable members 790, transports receiver medium 42 along transport path 2095. Receiver medium 42 contacts outer surface 2068 of fixing drum 2060 in contact region 2070. Contact region 2070 is located above stationary-drum liquid level 2020, so that when drum 2060 is stationary, heating liquid 415 is not in contact with inner surface 2061 in contact region 2070.

In various aspects, mixer 2038 is disposed inside volume 2015. Mixer 2038, in this example a fixed vane, mixes heating liquid 415 in volume 2015. In various examples, mixer 2038 is stationary as fixing drum 2060 rotates. Mixer 2038 can provide turbulence in heating fluid 415 during rotational acceleration, steady-state, or deceleration of fixing drum 2060. This can increase the temperature uniformity of heating fluid 415 by distributing heat from liquid-heating system 715.

Another example of a passive mixer uses spiral blade static mixer elements adhered to the inner surface of the drum to disrupt liquid flow inside the drum as the drum rotates and fluid flows by attraction of gravity. An example of an active mixer can include rotating vanes (one long spiral blade across entire axis or individual radial blade elements attached to a central axial shaft). Roller/ball/sleeve bearings can be used on both shaft ends for support and end seals can be used to close off exit/entry points of the drum to reduce heating-liquid leakage. Another example of a mixer is one external to the drum. Heating liquid can enter and exit the drum through one or more rotary seals in the end(s) of the drum, passing through the mixer when not in the drum. Such a mixer can be an impeller, diaphragm, gear, or other type of pump. The mixer can be a combination of a pump with a static mixer such as those sold by KOFLO, or a rotating blade, propeller, or other shearing device.

In various aspects, the temperature of warmed heating liquid 415 is less than a medium degradation temperature above which receiver medium 42 irreversibly degrades. In various aspects, the temperature of warmed heating liquid 415 is less than a toner degradation temperature above which toner 420 irreversibly degrades.

In some aspects, fixing drum 2060 is formed from sheet metal or another single-layer liquid-blocking barrier having inner surface 2061 and outer surface 2068. In other aspects, as shown in the inset, fixing drum 2060 includes moisture-impermeable cylinder 2058 (e.g., a liquid-blocking barrier, as described herein) having inner surface 2061. Outer layer 2059 is entrained around cylinder 2058. Outer layer 2059 has outer surface 2068. More than one layer can also be entrained around cylinder 2058. For example, outer layer 2059 can include a thermally-conductive elastomeric layer overcoated with a toner-release layer such as TEFLON or PFA. Outer surface 2068 of fixing drum 2060 can be an exposed surface of the toner-release layer. Examples of elastomers are given in U.S. Pat. No. 7,014,976 to Pickering et al., entitled "Fuser member, apparatus and method for electrostatographic reproduction," and U.S. Pat. No. 6,567,641 to Aslam et al., entitled "Sleeved rollers for use in a fusing station employing an externally heated fuser roller," which are incorporated herein by reference. Examples of release layers are given in U.S. Pat. No. 6,429,249 to Chen et al., entitled "Fluorocarbon thermoplastic random copolymer composition," and U.S. Pat. No. 6,797,348 to Chen et al., entitled "Fuser member overcoated with fluorocarbon-silicone random copolymer containing aluminum oxide," which are incorporated herein by reference.

FIG. 21 shows toner fixing systems as in FIG. 20 when fixing drum 2060 is rotating. Receiver medium 42 with surfaces 542, 543, rotatable members 790, toner 420, contact region 2070, transport path 2095, rotatable fixing drum 2060, stationary-drum liquid level 2020, volume 2015, heating liquid 415, liquid-heating system 715, surfaces 2061, 2068, and drive 2080 are as shown in FIG. 20.

While receiver medium 42 is transported and in contact with outer surface 2068 of fixing drum 2060, fixing drum 2060 rotates and receiver medium 42 moves at a transport speed substantially equal to the circumferential speed of rotation of drum 2060. The rotation of fixing drum 2060 pulls heating fluid 415 towards inner surface 2061 by centrifugal force, so heating fluid 415 enters contact region 2070, as shown. The centrifugal force draws heating fluid 415 above stationary-drum liquid level 2020. Heat is transferred from heating fluid 415 through inner surface 2061 and outer surface 2068 of rotating fixing drum 2060 from the drawn warmed heating liquid 415 to toner 420, thereby raising a temperature of toner 420 to a level above the toner glass transition temperature.

Sensor 2040 detect stoppages of receiver medium 42 in contact with fixing drum 2060. For example, sensor 2040 can detect a paper jam. Sensor 2040 can include an encoder measuring motion of receiver medium 42 through mechanical contact, or an optical sensor watching receiver medium 42 move. Controller 2086 is responsive to sensor 2040. When sensor 2040 detects a stoppage, controller 2086 automatically causes drive 2080 to stop the rotation of fixing drum 2060. When rotation stops, heating liquid 415 is pulled by gravity away from the stopped receiver medium 42. This advantageously reduces the probability of overheating of receiver medium 42.

The invention is inclusive of combinations of the aspects or aspects described herein. References to "a particular aspect" and the like refer to features that are present in at least one aspect of the invention. Separate references to "an aspect" or "particular aspects" or the like do not necessarily refer to the same aspect or aspects; however, such aspects are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred aspects and aspects thereof, but it will be understood that variations, combinations, and modifications can be effected by a person of ordinary skill in the art within the spirit and scope of the invention.

PARTS LIST

21 charger
21*a* voltage source
22 exposure subsystem
23 toning station
23*a* voltage source
25 photoreceptor
25*a* voltage source
26 intermediate member
31, 32, 33, 34, 35, 36 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
305 deposit pattern step
310 contact liquid and surface step
320 transport medium through reservoir step
321 shallow-angle transport step
322 superheat toner step
323 agitate heating liquid step
330 impinge heating liquid step
331 move medium step

332 impinge wave on medium step
401 environment
410 reservoir
412 slit
415 heating liquid
416 top surface
420 toner
421 bubble
422, 423 engine-pixel area
425 first side
429 pattern
431 lower zone
439 upper zone
444 transducer
450 pressurizer
451 impeller
453 jet
456 pressure zone
458 directing member
459 pump
490A rotatable member
495 transport path
510 liquid-supply system
515 liquid-heating system
520 liquid-delivery system
521 spraying system
530 roller
542, 543 surface
555 solidified heating liquid
556 detached solidified heating liquid
595 transport path
599 drop
615 liquid curtain
616 liquid-curtain direction
617 liquid-curtain speed
620 liquid-delivery system
621 curtain-coating system
622 slit
646 medium-transport direction
647 medium-transport speed
649 speed component
690 rotatable transport member
691 coating region
695 transport path
715 liquid-heating system
716 top surface
720 liquid-delivery system
721 tank
722 wave-forming system
723 nozzle
724 pump
725 stationary wave
726 peak
790 rotatable member
795 transport path
805 deposit pattern step
810 provide barrier step
820 contact surface and barrier step
830 contact heating liquid and barrier step
832 transport through reservoir step
834 absorb heating liquid into porous material step
835 transport porous material through reservoir step
836 impinge warmed heating liquid on barrier step
840 transport porous material through nip step
850 second anneal-toner step
942 entrained portion
961 inner surface
965 liquid-blocking barrier
968 outer surface
995 transport path
1010 sealing mechanism
1011, 1012 edge
1015 edge-clamping mechanism
1018 edge seal
1020 backing member
1021, 1022 rib
1042 lumen
1115 liquid cavity
1116 axis
1160 rotatable heating member
1161 inner surface
1165 liquid-blocking barrier
1168 outer surface
1175 barrier layer
1180 backing member
1195 transport path
1270 contact zone
1280 porous material
1285 dryer
1295 transport path
1310 path portion
1395 transport path
1410 path portion
1480 porous belt
1495 transport path
1520 liquid delivery system
1556 detached solidified heating liquid
1561 inner surface
1568 outer surface
1570 contact zone
1571 agitator
1595 transport path
1615 liquid curtain
1695 transport path
1795 transport path
1812 vapor layer
1820 drop
1821 moisture
1842 surface
1910 nip
1920, 1925 rotatable member
1930, 1935 nip position
1941 annealing device
1942 fixed toner
1946 heat source
1980 squeezed porous material
1995 transport path
2015 volume
2020 stationary drum liquid level
2038 mixer
2040 sensor
2058 moisture-impermeable cylinder
2059 outer layer
2060 fixing drum
2061 inner surface
2068 outer surface
2070 contact region
2080 drive
2086 controller
2095 transport path
T, T2 thickness
θ angle

The invention claimed is:

1. A toner fixing system for fixing toner onto a receiver medium, the toner having a toner glass transition temperature, comprising:

a reservoir containing a heating liquid;

a liquid-heating system for warming the heating liquid in the reservoir to a temperature greater than the toner glass transition temperature;

a rotatable liquid-blocking barrier with an inner surface and an outer surface;

a media-transport system for transporting the receiver medium along a transport path in which the receiver medium contacts or is entrained around the liquid-blocking barrier in a contact zone so that the receiver medium is brought into contact with the outer surface of the liquid blocking barrier; and a porous material arranged to absorb heating liquid from the reservoir and bring the absorbed heating liquid into contact with the inner surface of the liquid blocking layer for at least a portion of the contact zone, such that heat is transferred through the liquid-blocking barrier from the absorbed warmed heating liquid to the toner, thereby raising a temperature of the toner to a level above the toner glass transition temperature.

2. The toner fixing system of claim 1 wherein the warmed heating liquid undergoes a phase change while heat is being transferred from the warmed heating liquid to the toner, and wherein the phase change releases heat such that at least a portion of the released heat contributes to raising the temperature of the toner.

3. The toner fixing system of claim 2 wherein the phase change is a liquid-to-solid phase change, or another phase change that releases heat.

4. The toner fixing system of claim 1 wherein the temperature of the warmed heating liquid is less than a medium degradation temperature above which the receiver medium irreversibly degrades.

5. The toner fixing system of claim 1 wherein the temperature of the warmed heating liquid is less than a toner degradation temperature above which the toner irreversibly degrades.

6. The toner fixing system of claim 1 wherein the porous material is permanently affixed to the inner surface of the liquid-blocking barrier.

7. The toner fixing system of claim 6 wherein the rotatable liquid-blocking barrier is a circumferential surface of a drum which rotates around a central axis.

8. The toner fixing system of claim 7 wherein the contact zone corresponds to an upper portion of the drum and a lower portion of the drum is submerged in the heating liquid in the reservoir where the porous material absorbs heating liquid, and wherein the drum rotates to transport the absorbed heating liquid up to the contact zone.

9. The toner fixing system of claim 6 wherein the rotatable liquid-blocking barrier is a belt that is transported around a belt path.

10. The toner fixing system of claim 9 wherein the belt is submerged in the heating liquid in the reservoir for a portion of the belt path where the porous material absorbs heating liquid, and wherein the belt moves around the belt path to transport the absorbed heating liquid to the contact zone.

11. The toner fixing system of claim 1 wherein the porous material forms a porous belt that is transported around a porous belt path, and wherein the porous belt is brought into contact with the inner surface of the liquid-blocking barrier for a first portion of the porous belt path corresponding to at least a portion of the contact zone.

12. The toner fixing system of claim 11 wherein the porous belt is transported through the reservoir containing the heating liquid during a second portion of the porous belt path where the porous material absorbs the warmed heating liquid.

* * * * *